United States Patent [19]

Morita

[11] Patent Number: 4,576,028

[45] Date of Patent: Mar. 18, 1986

[54] METHOD OF MAKING A COIL SPRING AND APPARATUS THEREFOR

[75] Inventor: Motoo Morita, Nagoya, Japan

[73] Assignee: Morita Iron Works Co., Ltd., Aichi, Japan

[21] Appl. No.: 646,018

[22] Filed: Aug. 31, 1984

[30] Foreign Application Priority Data

Sep. 1, 1983 [JP] Japan ..... 58-160625

[51] Int. Cl.[4] ..... B21F 3/04

[52] U.S. Cl. ..... 72/143; 72/138; 242/7.01

[58] Field of Search ..... 72/138, 142, 143, 145; 242/7.01, 7.06, 7.07, DIG. 2, 159

[56] References Cited

U.S. PATENT DOCUMENTS 2,758,629 8/1956 Lewis ..... 72/142
3,106,177 10/1963 Nicolaisen ..... 72/145

FOREIGN PATENT DOCUMENTS 2075880 11/1981 United Kingdom ..... 72/142

*Primary Examiner*—Lowell A. Larson
*Assistant Examiner*—Jorji M. Griffin
*Attorney, Agent, or Firm*—Schwartz & Weinrieb

[57] ABSTRACT

Disclosed herein is an improved method and apparatus for making a coil spring wherein a wire material is fed on a line of feed which is maintained at a constant position relative to a mandrel adapted for winding the wire material. The mandrel is controlled to pivot into a predetermined angular winding position relative to the line of feed and to move in the axial direction thereof so as to form the wire material into a spring.

35 Claims, 51 Drawing Figures

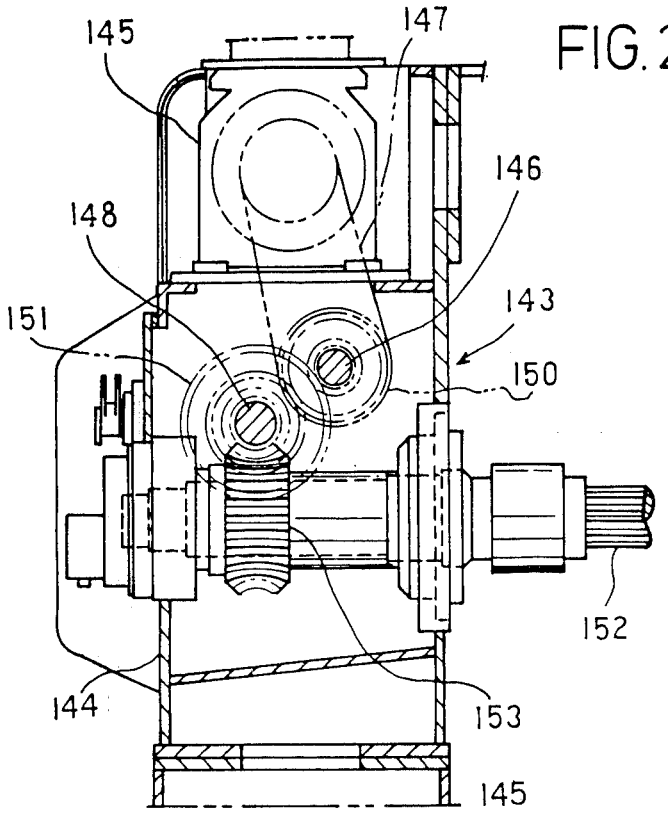
FIG. 25
FIG. 26
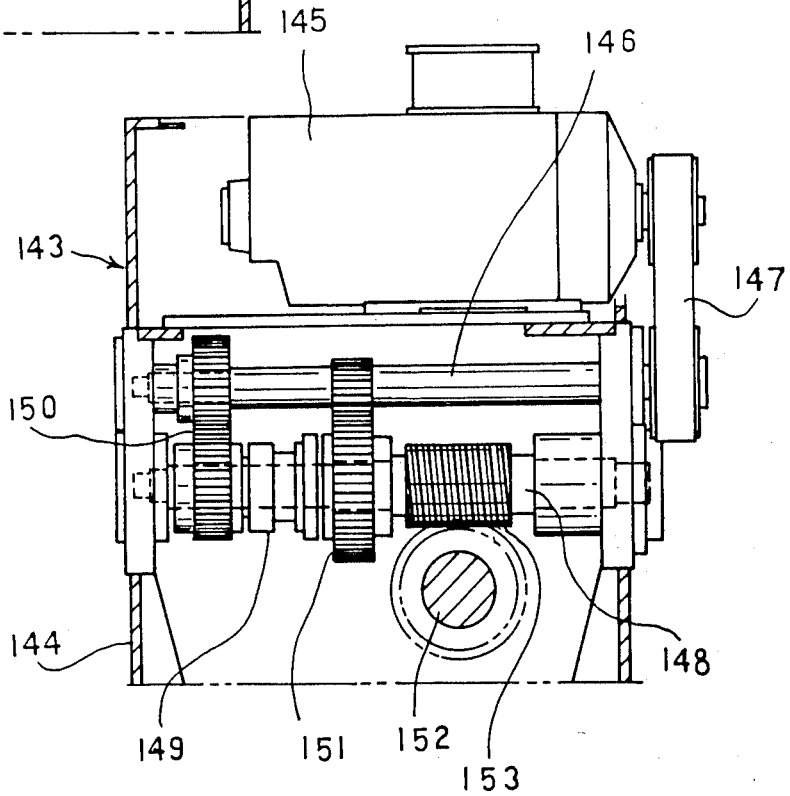

PRIOR ART

METHOD OF MAKING A COIL SPRING AND APPARATUS THEREFOR

BACKGROUND OF THE INVENTION

1. Field of the Invention

This invention relates generally to a method of making a coil spring and an apparatus therefor. More particularly, this invention provides a method and apparatus for winding a selected length and diameter of a wire material into a spiral configuration by using a mandrel so as to automatically make a coil spring, particularly a large compression spring having seats at its opposite ends.

2. Description of the Prior Art

In making coil springs, two types of wire material, cold and hot, are usually employed dependent on the size of coil springs to be formed. First, cold wires are used to permit cold working on small springs formed of relatively thin or small-diameter wires. Second, hot wires previously heated to a predetermined high temperature are used to permit hot working on large coil springs formed of relatively thick or large-diameter wires. In either form of manufacturing process, it is necessary to accurately set and maintain the feeding position and posture of a wire material relative to the mandrel so that the winding requirements are satisfactorily fulfilled. Especially, in manufacture of springs having seats or wedge-shaped rolled portions previously formed on their opposite ends, it is essential that the orientation and position of such rolled portions be held accurately to suit the winding requirements.

The previously known art of manufacturing springs will now be described briefly. In general, the "shiftable wire-based winding process" has hitherto been employed. FIG. 45 is a schematic illustration of such a process, and as may be seen, a mandrel M′ on a winding machine, being set at a fixed position and orientation, is rotated at a constant speed in a desired direction, while a wire on a feeding machine is fed toward the mandrel M′ and moved in the axial direction of the mandrel, thus shifting its direction of advancement (the angle of feed) progressively to suit a selected pitch of the spring to be wound by the mandrel M′.

However, such a process includes a number of potential problems. Normally, the wire on the feeding machine has to be gradually shifted in the axial direction of the mandrel, requiring a relatively complex and large machine and hence a considerably large area for its installation. This runs counter to the general tendency toward the simplification of such manufacturing lines. In addition, since the direction of wire advancement is shifted by the movement of the feeding machine (in other words, the direction of wire advancement is selected dependent on the movement of the feeding machine), the prior art process fails to accurately set the posture and angle of wire advancement relative to the mandrel, and deformation, such as bend and deflection, of the wire can result. Therefore, the process still has a number of problems to be overcome in winding the wire properly as desired and manufacturing high quality springs having accurate and stable shape (particularly in terms of pitch) continuously at high speeds.

Further, the prior art method of manufacturing springs, where wires are shifted during their advancement, entails considerable danger such as during a hot forming process. Namely, when wires with rolled portions are processed, a plurality of operators are required to check and correct the orientation of the rolled portions at an appropriate stage in the latter half of the winding process. At that time, no matter how skillful they are in such a correcting operation, they are liable to danger such as a burn, as the operation is carried out during the shifting movement of hot material. In addition, the important considerations are the safety and prudence in performing such an operation; and reliable cooperation between the machine operators. Apparently, all of these factors have contributed to failure to speed up the overall manufacturing operation and to improve the productivity.

OBJECTS OF THE INVENTION

It is, accordingly, an object of the present invention to overcome the above-described problems associated with the prior art.

It is another object of the present invention to provide a method and apparatus by which safety and efficiency in operation may be increased.

It is a further object of the present invention to provide such apparatus which is compact in construction and yet which has improved capability.

It is still another object of the present invention to provide a method and apparatus which can make high quality springs having stable and accurate configuration by winding wire materials with a high degree of accuracy while holding the materials at their stable posture.

It is a still further object of the present invention to provide such apparatus which can efficiently make either wind of springs, right-hand or left-hand, by varying the line of the material feed, the direction of rotation of mandrel and the chucking position to suit the type of wind of springs to be made.

SUMMARY OF THE INVENTION

In accordance with the present invention, there is provided a method of making a coil spring wherein a wire material is fed on a line of feed and formed into a spring by use of a mandrel adapted to rotate on the basis of chucking position to wind the wire material, the mandrel being controlled to pivot into a predetermined angular winding position relative to the line of feed and to move in the axial direction thereof. The invention method comprises the steps of feeding the wire material at a selected speed and continually in alignment with the line of feed, regulating the orientation and position of the head end of the wire material in the forward part of the line of feed, directing the wire material regulated on its head end to a chucking position established on the outer periphery of the mandrel and aligned with the line of feed, controlling the winding position of the mandrel to pivot about a fulcrum aligned with the chucking postion and to shift between a reference position perpendicular to the plane of the line of feed and a pivoted position forming an acute angle relative to the reference position, moving the mandrel toward and away from the predetermined winding position while removably holding the mandrel, and regulating the tail end of the wire material at a predetermined time during the winding process so as to control the orientation of the tail end to an angle commensurate with the angle of twist of the wire material which will necessarily be developed before the remaining unwound length of the wire material is wound. In this way, the wire material may be fed as it is held in a fixed position and at a stable posture at all times, and may be serially wound at a desired angle by the mandrel. Thus, springs having an accurate shape, size, pitch and pitch angle, and especially coil springs having opposite seats may be efficiently formed.

The present invention provides the "pivotal and movable mandrel-based winding process" which is basically different from the "shiftable wire-based winding process" as described in the preceding paragraphs. Therefore, the overall manufacturing line may be simplified and yet the manufacturing equipment used in conjunction with the present method may be made compact. In addition, human operations may be minimized in the overall manufacturing process; the required operation includes simply taking out a wire material from the heating furnace and making a preliminary adjustment of the posture of the wire material. Thus, the number of operators may be minimized and the apparatus safely operated without requiring men of skill. Further, a high-speed operation may be attained by reducing delays which might be caused by human operations.

Also, in accordance with the present invention, there is provided an apparatus for performing the method which includes a feed section adapted to hold and feed a wire material in alignment with the line of feed; and a cooperating wind section disposed transversely to the plane of the feed section and including a mandrel mounted thereon for winding the wire material, the mandrel being adapted for pivotal movement into a predetermined angular winding position relative to the line of feed and for rotational movement about and reciprocating movement along the axis thereof. The invention apparatus comprises feeder means mounted on a frame of the feed section and adapted to feed the wire material at a selected speed and continually in alignment with the line of feed, head end regulator means disposed in the forward part of the line of feed for regulating the orientation and position of the head end of the wire material, feed-out means for directing the wire material regulated on its head end to a chucking position established on the outer periphery of the mandrel and aligned with the line of feed, swivel means for controlling a swivel base of the wind section to pivot about a fulcrum aligned with the chucking position and to shift between a reference position perpendicular to the plane of the line of feed and a pivoted position forming an acute angle relative to the reference position, drive means for controlling the mandrel to rotate about the chucking position, movable holder means for moving the mandrel toward and away from the predetermined winding position while removably holding the mandrel, and tail end regulator means mounted on the feed section and having a regulating tool adapted to regulate the tail end of the wire material at a predetermined time during the winding process so as to control the orientation of the tail end to an angle commensurate with the angle of twist of the wire material which will necessarily be developed before the remaining unwound length of the wire material is wound. With this arrangement, high quality coil springs may be accurately manufactured, and even in a hot forming process, springs may be manufactured safely and efficiently at high speeds by reducing as much human operations as possible.

The invention apparatus employs the "pivotal and movable mandrel-based winding process" which eliminates the need for shifting the feed of wire material, and thus the overall apparatus may be simplified and the whole line made compact, thereby making it possible to produce springs accurately while eliminating variations in wire material.

In another embodiment of the present invention, the apparatus further includes an elevating pedestal mounted on the frame of the feed section and adapted to shift between predetermined high and low positions. By means of this arrangement, the feeder means, head end regulator means, feed-out means and tail end regulator means, being mounted on the elevating pedestal, may be set to the respective lines of feed for right-hand wind or left-hand wind. Additionally, in the wind section, the mandrel may be controlled to rotate in either direction and the chucking position shifted into a position aligned with the respective line of feed. With this arrangement, various type of springs, for either right-hand wind or left-hand wind, may be formed accurately and efficiently, thereby increasing the versatility of the apparatus.

Further, by means of the cooperating action of a head end bender means mounted on the elevating pedestal and a tail end hold-down means located in an operative position opposite to the mandrel, both the head end and the tail end of the wire material, being bent in the direction of wind, may closely contact the outer periphery of the mandrel. Because of this, springs having accurate and stable end configuration may be formed. Also, the guide means aligned with the respective line of feed for either right-hand wind or left-hand wind, include rollers placed in suitable guide positions spaced a predetermined distance away from the mandrel. The rollers serve to press and guide the wire material onto the outer periphery of the mandrel so that floating, bend and deformation of the wire material may advantageously be eliminated to provide springs having accurate diameter and pitch.

BRIEF DESCRIPTION OF THE DRAWINGS

The invention will now be described by way of example and with reference to the accompanying drawings, in which:

FIGS. 25 and 26 are sectional front and sectional side views, respectively, of the drive means of the mandrel;

DETAILED DESCRIPTION OF THE INVENTION

Figure 40:
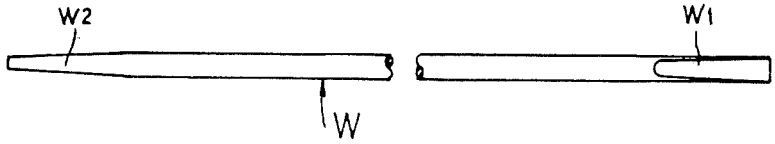
FIG. 40 is a front view of a wire material.

The inventive method and apparatus for making a coil spring will be described in detail with reference to the drawings. The preferred embodiment is chosen and described to explain the hot forming process wherein a wire material W with tapered ends (rolled portions at the opposite ends) shown in FIG. 40 is formed into a coil spring S shown in FIG. 41.

Figure 1:
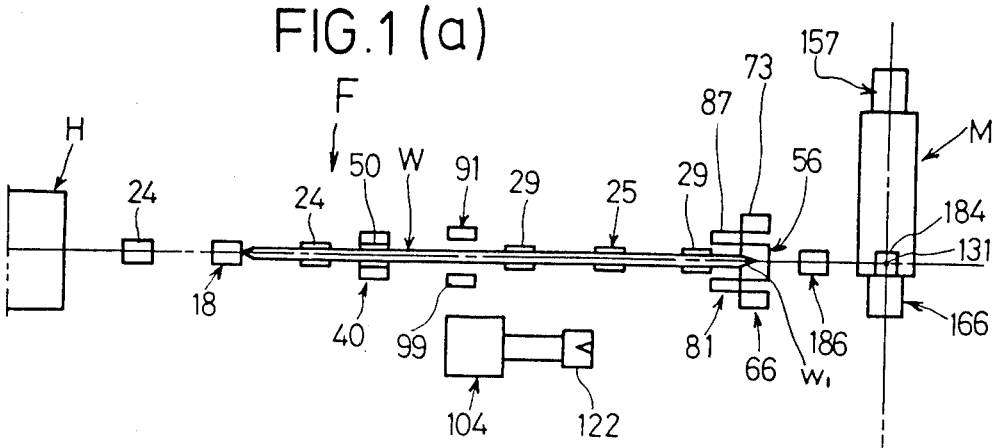
FIGS. 1(*a*)–1(*e*) are schematic plan views of the overall apparatus for performing the invention method, showing the apparatus operation and the various components used in conjunction therewith.
Figure 1:
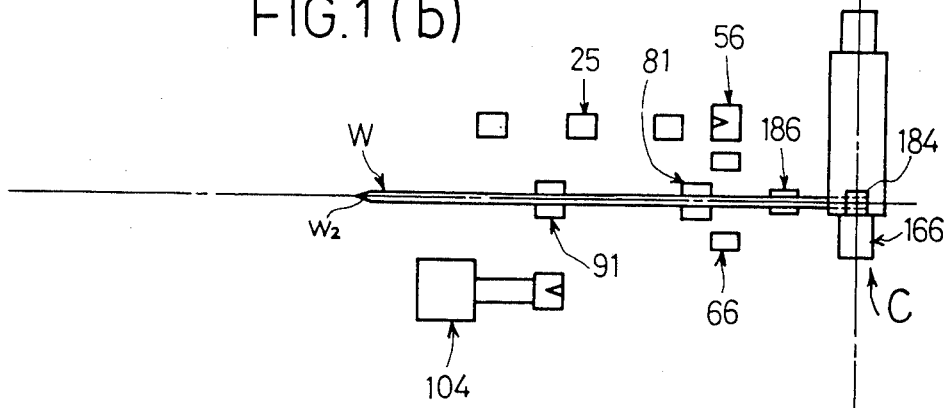
Figure 1:
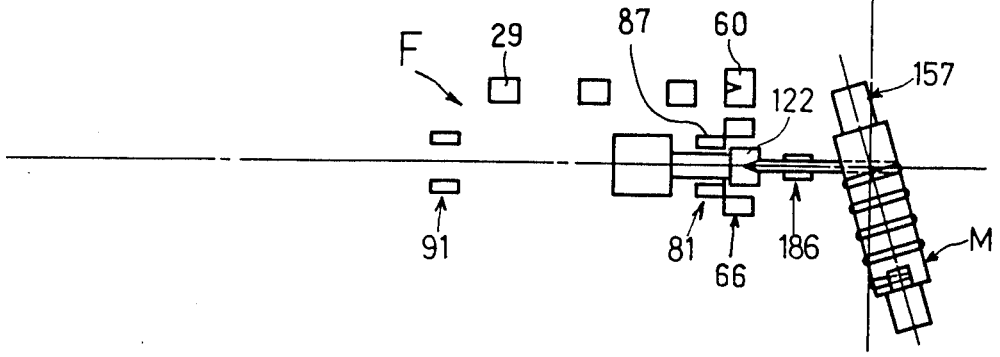
Figure 1:
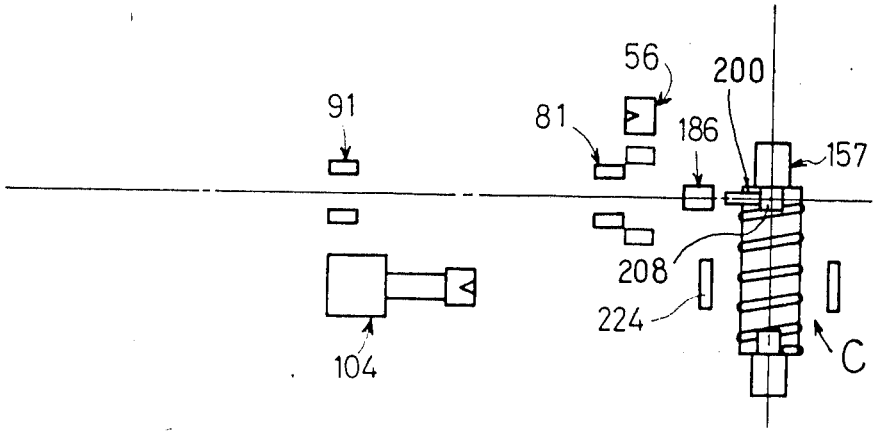
Figure 1:
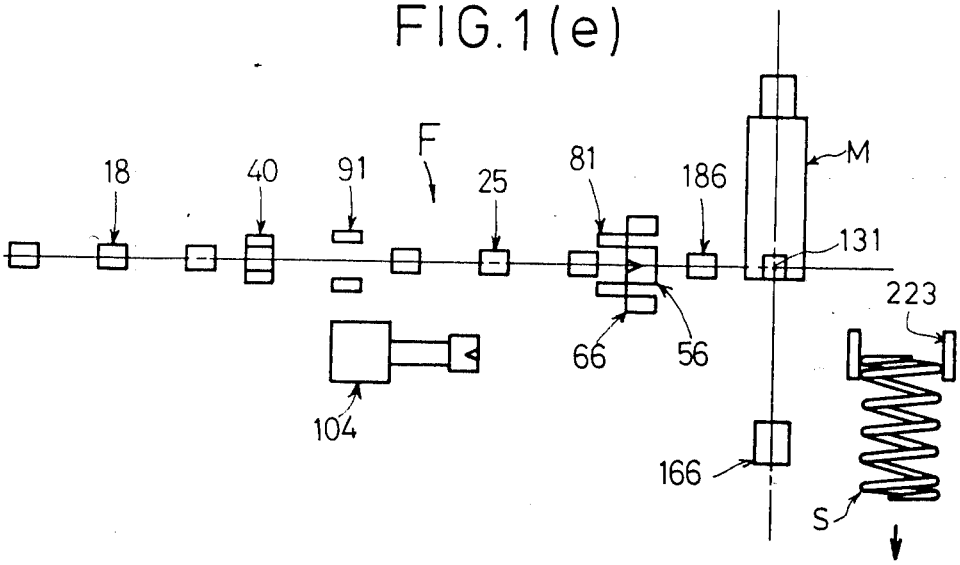

Prior to the description of the invention method, the apparatus for performing the method will be described. Broadly the apparatus includes, as represented in FIG. 1, two interrelated cooperating operative sections by which a wire material W taken from a heating furnace H is formed into a coil spring S. The operative sections of the apparatus in FIG. 1 are: feed section F for holding the wire W in alignment with a selected line of feed dependent on the type of wind, right-hand or left-hand; and wind section C disposed transversely to the plane of feed section F to form a generally T-shaped configuration and adapted to control a mandrel M mounted thereon for its pivotal displacement of wind position, for rotational movement in either direction and for axially reciprocating movement, in accordance with the selected line of feed. In the following specification, therefore, the principal components of the apparatus will be described in relation to these two sections, respectively. Also, to facilitate the description of several transmission means in the apparatus, sprockets and chains will be simply referred to as a chain train, and gears as a gear train.

Figure 2:
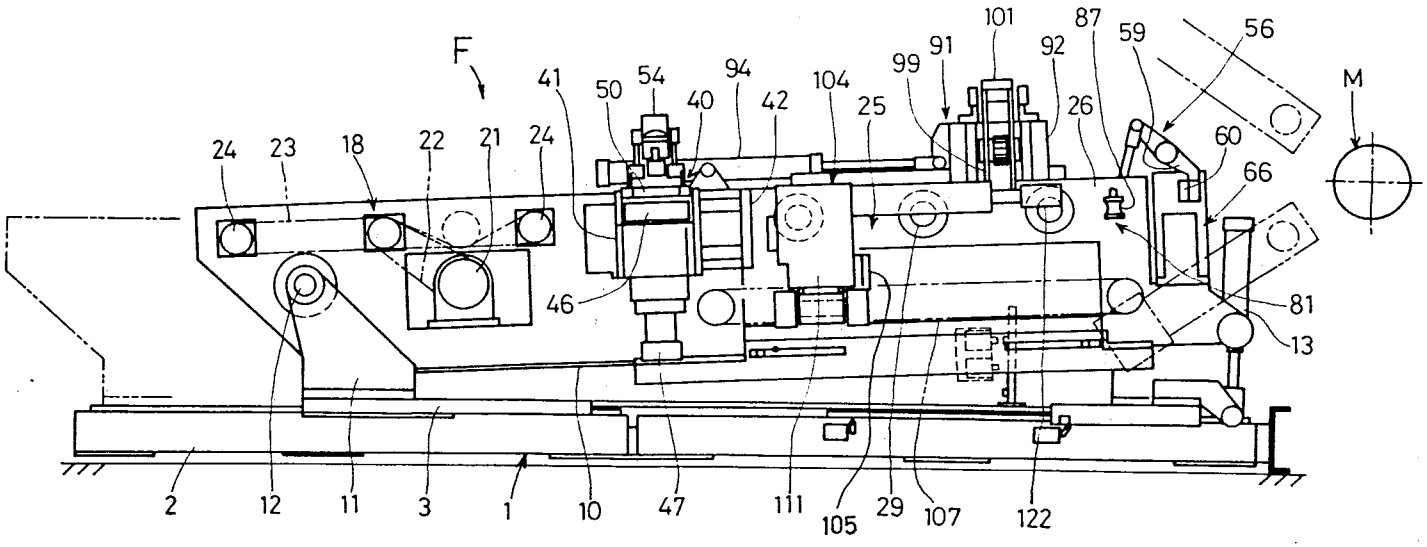
FIGS. 2, 3, and 4 are front, top, and sectional side views, respectively, of the wire feed section of the invention apparatus.
Figure 3:
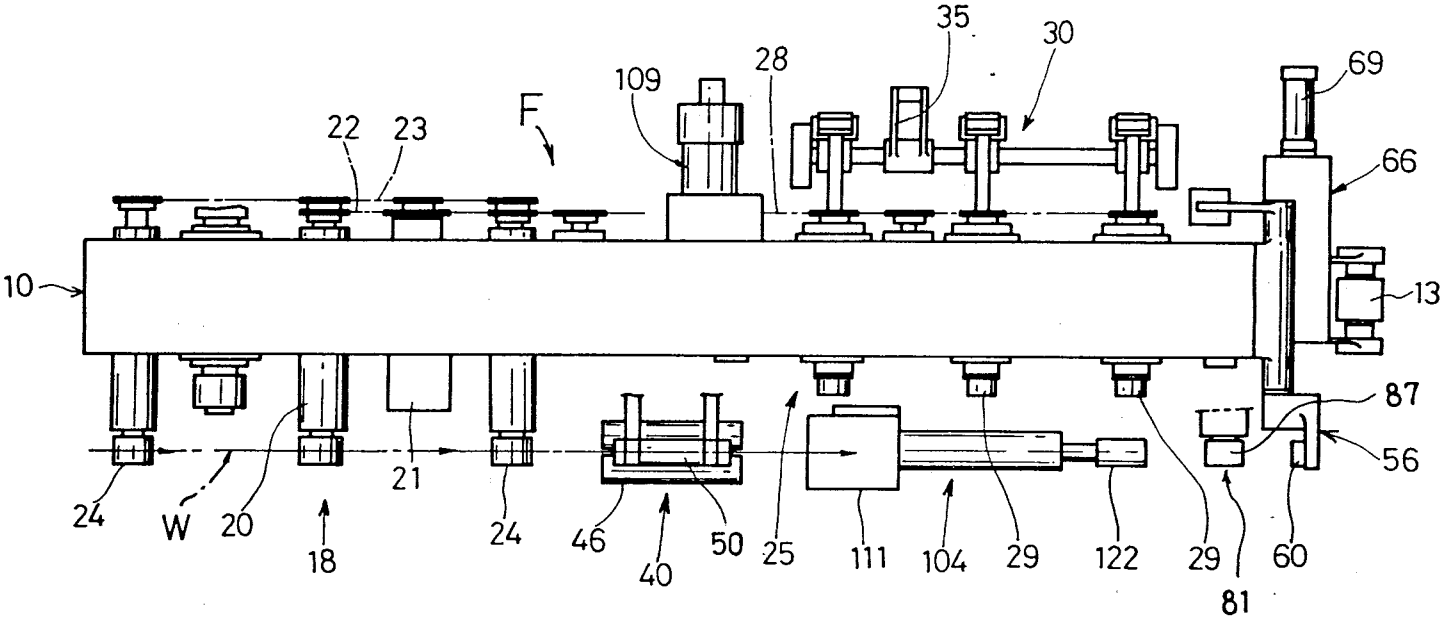
Figure 4:
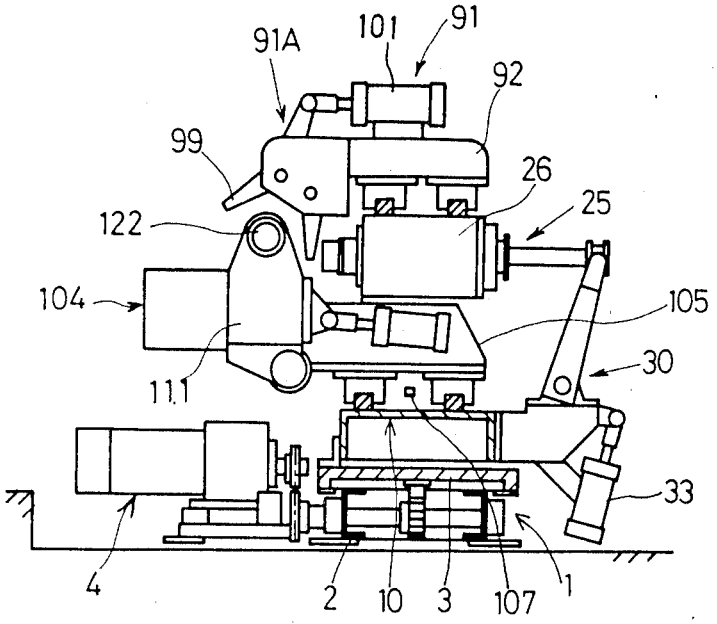
Figure 5:
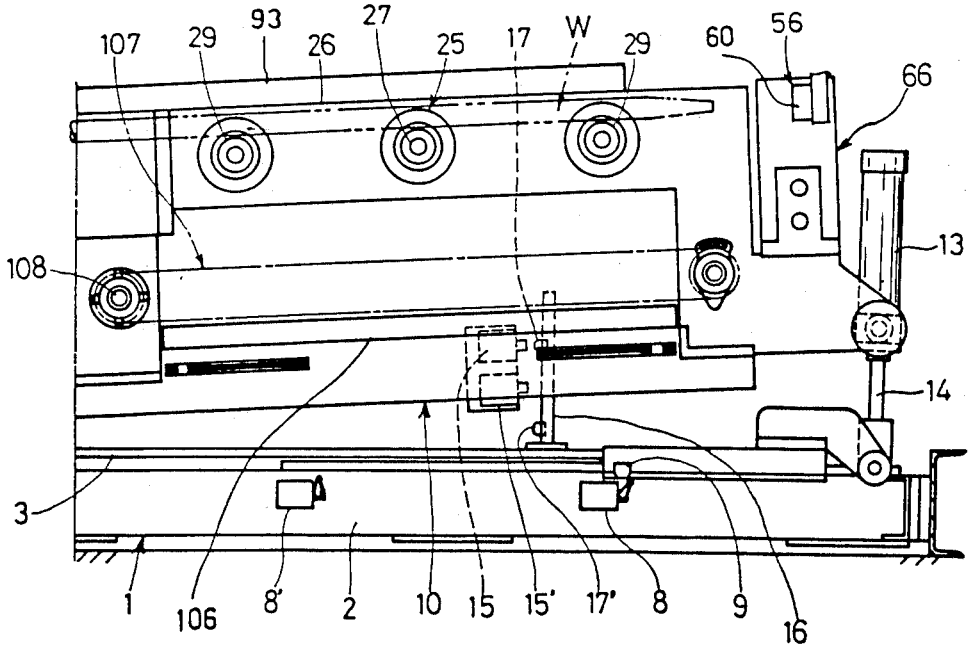
FIG. 5 is a front view of a part of the frame of the feed section.
Figure 7:
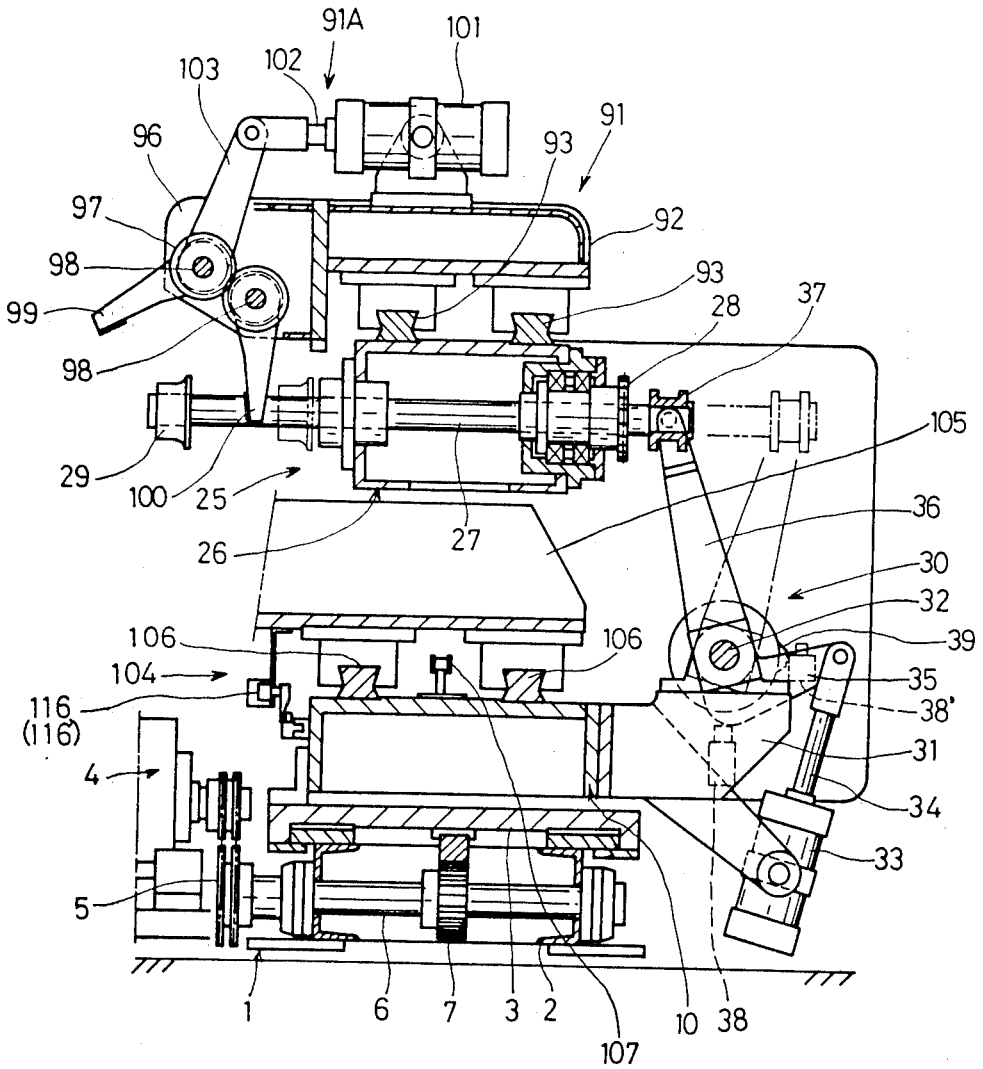
FIG. 7 is a sectional side view of the overall feed section.

The feed section F is supported on a suitable frame 1 and includes several principal subassemblies for feeding a wire material, which are arranged in alignment with the line of feed, as schematically shown in FIGS. 2, 3 and 4. The principal subassemblies of the feed section F are first feeder means 18, second feeder means 25, posture retaining means 40, head end regulator means 56, head end bender means 66, feed guide means 81, clamp and feed-out means 91 and tail end regulator means 104. The frame 1 has a fixed base 2 secured thereto and a sliding base 3 slidably supported on the fixed base 2 for longitudinal movement relative to the fixed base 2. To set the respective subassemblies at a proper position and height commensurate with the length of wire and the direction of wind (right-hand or left-hand), an elevating pedestal 10 is provided and is secured to the sliding base 3, as shown in FIGS. 2, 5 and 7. The sliding base 3 is driven by a reversible motor 4 mounted on one end of the fixed base 2 and is connected to the motor 4 through a chain train 5. The drive of motor 4 enables the sliding base 3 to shift between two positions, forward and rearward, in the direction of wire advancement, through a rotary shaft 6 and a rack and pinion train 7 carried by the fixed base 2. Reference numberals 8 and 8′ designate position sensors which are disposed on one side of the fixed base 2 and actuable to stop the motor 4 upon contact with a dog 9 on the sliding base 3.

The elevating pedestal 10 is located on the sliding base 3 and parallel to the line of feed, the rearward portion (adjacent the heating furnace H) being supported by a fulcrum shaft 12 in a subframe 11 secured to the sliding base 3. The elevating pedestal 10 is slantingly elevated by means of a shift cylinder 13 with a rod 14 which is secured to the forward end of the elevating pedestal 10 and which is adjustable for its amount of travel relative to the rod 14 connected at its lower end to the sliding base 3. Thus, the elevating pedestal 10 is shiftable between two height levels which are aligned with the respective lines of feed for right- and left-hand winds. Reference numerals 15 and 15′ are height sensors which are mounted to on the elevating pedestal 10 and actuable to stop the cylinder 13 upon contact with dogs 17 and 17′ secured to a support bar 16 on the sliding base 3.

Figure 6:
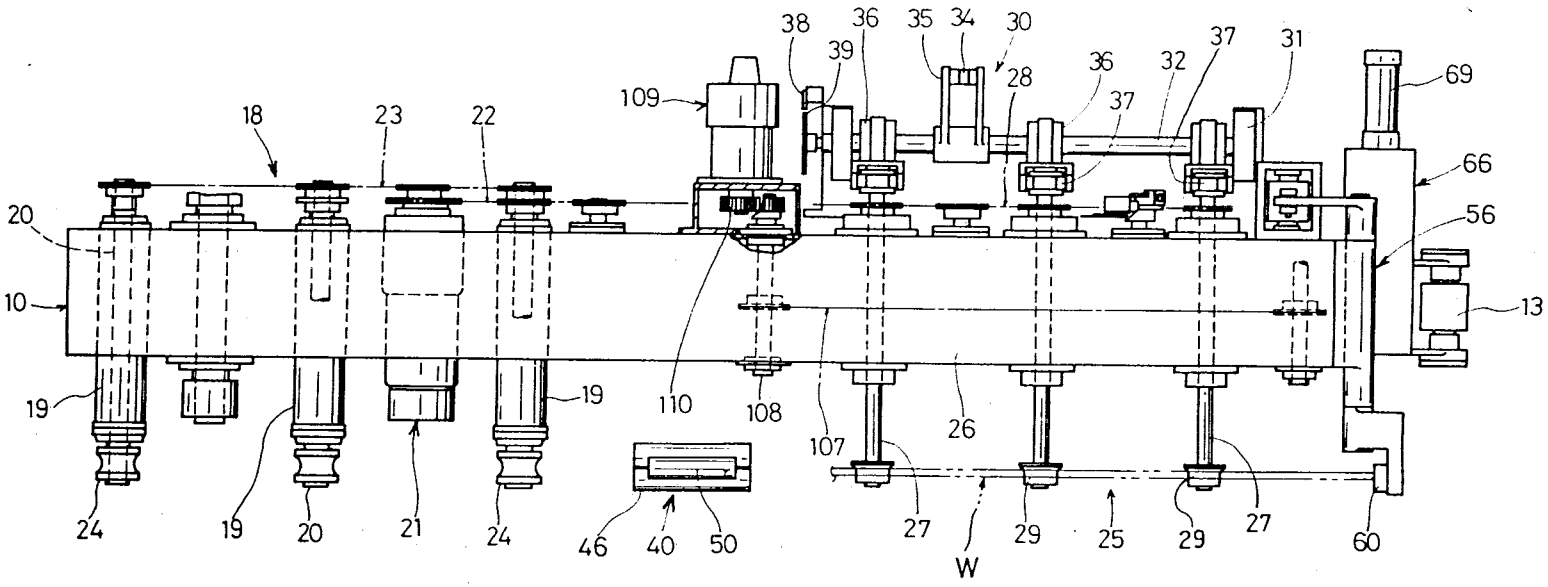
FIG. 6 is a plan view of the first and the second feeder means of the invention apparatus.

The first feeder means 18 serves to feed the wire material taken from the heating furnace H at a selected speed. As shown in FIGS. 2, 3 and 6, the first feeder means 18 includes a plurality of support sleeves 19 (three sleeves shown in the drawings) carried in the rearward end of the elevating pedestal 10. Each of the support sleeves 19 includes a rotary shaft 20 extending therethrough in a direction perpendicular to the line of feed. The rotary shafts 20 are connected to a motor mounted to the backside of the elevating pedestal 10 through a first and a second chain train 22 and 23, and are rotatable synchronously with each other. Each rotary shaft 20 has on its front end a roller 24 which is aligned with the line of feed. The motor 21 may preferably of a variable speed motor. Additionally, as best seen in FIG. 6, each of the rollers 24 is provided with a concave recess and opposite flanges to assist in guiding the wire of a selected diameter.

The second feeder means 25 serves to feed and guide the wire material W, in association with the first feeder means 18, toward the mandrel M on the wind section C. As shown in FIGS. 5, 6 and 7, the second feeder means 25 includes a support base 26 located generally above the forward end of the elevating pedestal 10, which support base 26 includes a plurality of rotary shafts 27 axially movably carried therein and extending therethrough in a direction perpendicular to the line of feed. The rotary shafts 27 are operatively connected to the motor 21 through a chain train 28 and are rotatable synchronously with each other. It is to be noted that another individual motor may be provided separately from the first feeder means 18. Each of the rotary shafts 27 has a roller 29 fixedly connected at the front end thereof. Each of the rollers 29 is provided on its one side a flange to assist in isolation from the wire material.

The second feeder means 25 further includes a shifting mechanism 30 disposed generally at the back of the elevating pedestal 10 and adapted to shift the rollers 29 between a position of alignment with the line of feed and a retracted position in appropriate timing with the starting and completion of feed of the wire material. As shown in FIGS. 6 and 7, the shifting mechanism 30 includes a pivotal shaft 32 supported between support frames 31 secured to the back of the elevating pedestal 10. A separate shift cylinder 33 is connected to the elevating pedestal 10, and the cylinder 33 has a rod 34 connected to the pivot shaft 32 through a connecting lever 35. The pivotal shaft 32 has connected thereto upwardly extending shift levers 36 which in turn are connected to the respective rearward end of the rotary shafts 27 through rotation guides 37. With this arrangement, therefore, the up and down movement of the rod 34 of the cylinder 33 causes all the levers 36 on the pivotal shaft 32 to pivot in the longitudinal direction (as viewed in FIG. 7), thereby to shift the rotary shafts 27 and hence the rollers 29 between a guiding position and an inactive position relative to the wire material. Reference numerals 38 and 38′ denote sensors for confirming the shifting operation; and reference numeral 39 denotes a dog.

Figure 8:
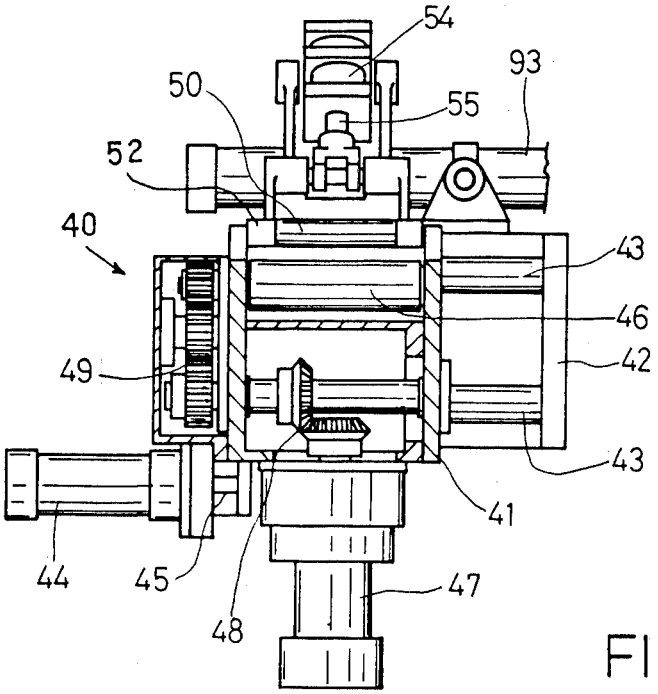
FIGS. 8 and 9 are front and side views, respectively, of the posture-retaining means.
Figure 9:
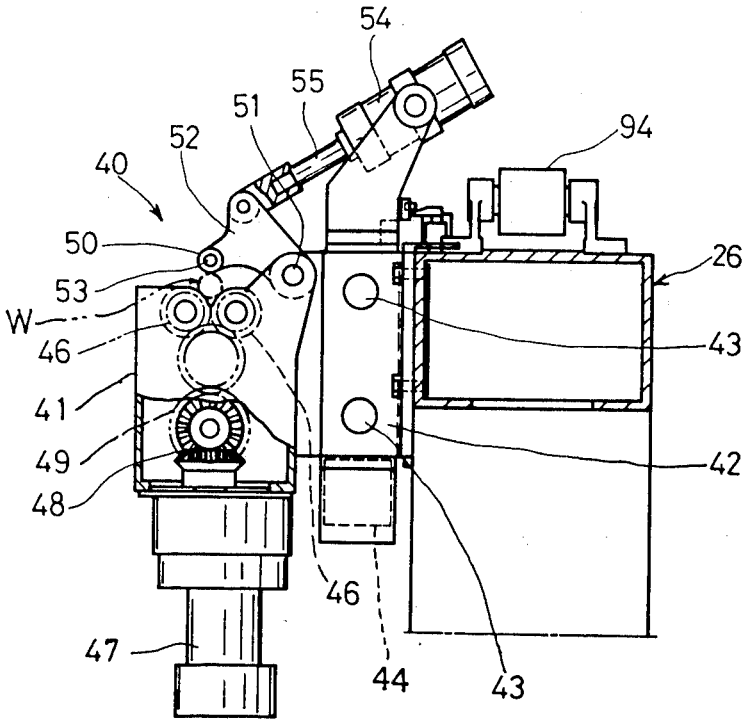

Disposed between the first and the second feeder means 18 and 25 is the posture retaining means 40 which is movable (adjustable for its position) in the direction of the line of feed. The posture retaining means 40 is utilized to hold and guide the wire material, while correcting the posture of wire, especially the orientation of the rolled head end W1. As shown in FIGS. 2, 8 and 9, the posture retaining means 40 includes a casing 41 disposed in front of the support base 26 of the elevating pedestal 10. A support frame 42 is connected to the support base 26 and has a pair of horizontally extending guide bars 43 by which the casing 41 is movably carried. In addition, a cylinder 44 is connected to the support frame 42 and has a rod 45 connected to the casing 41. By means of this arrangement, the actuation of the cylinder 44 causes the casing 41 to move along the direction of the line of feed into a position commensurate with the length of wire material.

The casing 41 has on its top surface a pair of guide rollers 46. A hold-down roller 50 is provided above the rollers 46 and is utilized to hold the wire material from lifting. All of these rollers 46 and 50 are arranged in the same direction as the line of feed. The guide rollers 46 are connected to a motor 47 mounted on the underside of the casing 41 through a bevel gear train 48 and a spur gear train 49, and are simultaneously rotated in opposite directions. The rollers 46 serve to receive the wire material between their outer peripheral surfaces while holding the wire material in alignment with the line of feed, thereby to prevent possible circumferential displacement of the wire material.

The hold-down roller 50 is rotatably carried by a pair of arms 52 which in turn are pivotally supported by a support shaft 51 located at the upper end of the casing 41. The arms 52 are connected to a shift cylinder 54 with a rod 55 located generally above the casing 41. Thus, the actuation of the cylinder 54 causes the roller 50 to shift between a guiding position holding the material in vertical alignment with the line of feed and a retracted position outside the line.

Figure 10:
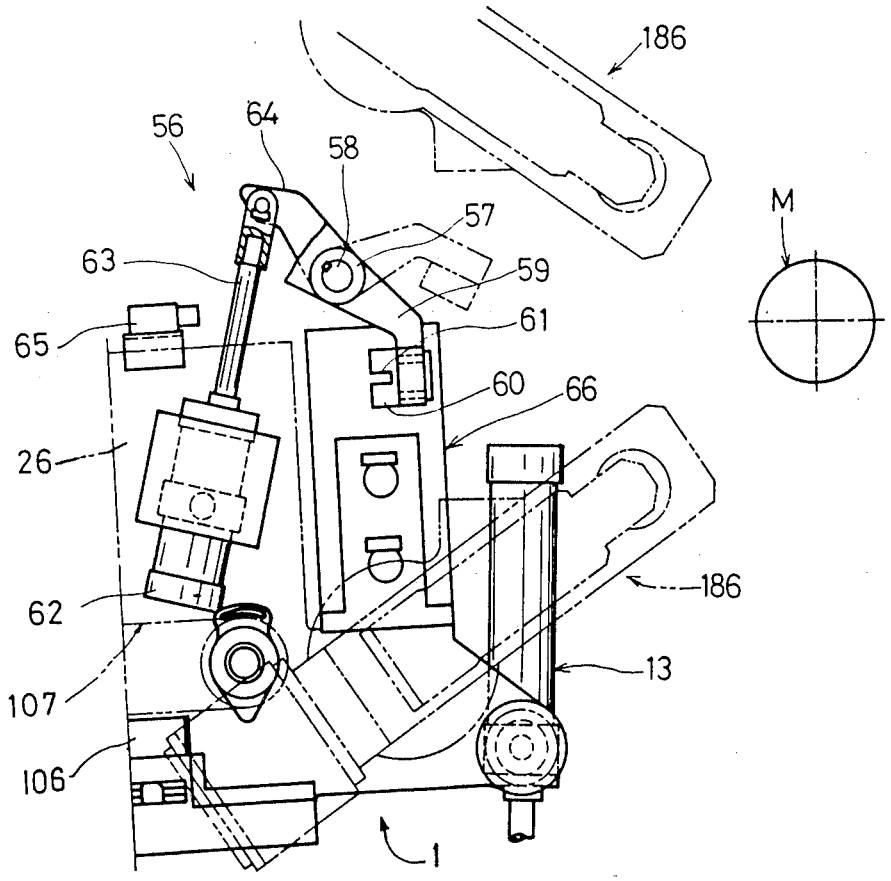
FIGS. 10 and 11 are front and top views, respectively, of the head end regurator means.
Figure 11:
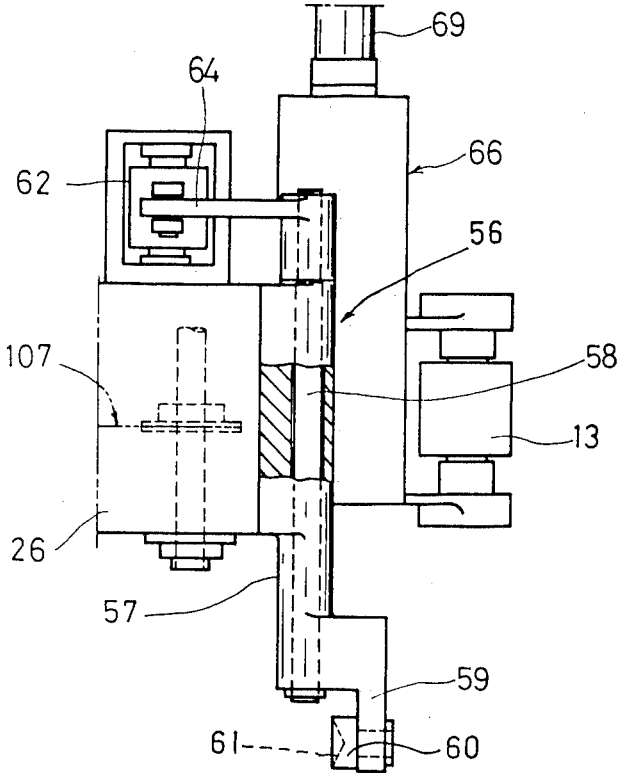

The head end regulator means 56 is located on the forward end of the elevating pedestal 10, that is in front of the mandrel M, and is utilized to regulate the posture (orientation) and position of the rolled forward portion W1 of the wire material prior to winding operation. As may be seen in FIGS. 2, 10 and 11, the elevating pedestal 10 includes a pivotal shaft 58 horizontally received in a support sleeve 57 mounted to the upper forward end of the support base 26. A regulating tool 60 is mounted to a connecting arm 59 provided at the forward end of the pivotal shaft 58. The regulating tool 60 has formed therein a regulating mouth 61 into which the rolled forward portion W1 is engageble. The regulating tool 60 is tilted upwardly by the actuation of a shift cylinder 62, being shifted between an operative position in which the tool 60 is aligned with the line of feed and an inactive position in which the tool 60 is retracted upwardly outside the line. The regulating tool 60 is normally set in its operative position in appropriate timing with the feed of wire material, and upon completion of its regulating operation, the tool 60 is instantly returned to its inactive position. The cylinder 62 is mounted on the backside of the support base 26, its rod 63 being connected to an arm 64 provided at the rearward end of the pivotal shaft 58. Reference numeral 65 designates a sensor for confirming the shifted position of the regulating tool 60 which is located opposite to the path of the regulating tool operated by the arm 64.

Figure 12:
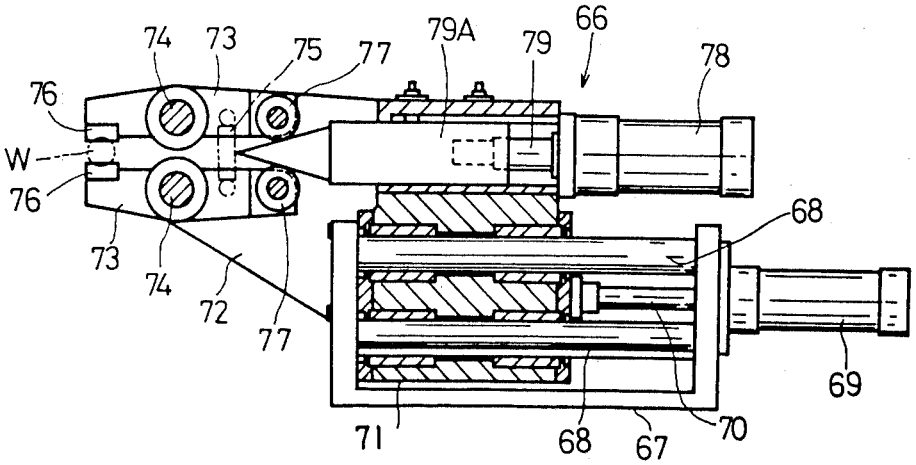
FIGS. 12 and 13 are sectional side and plan views, respectively, of the head end bender means.
Figure 13:
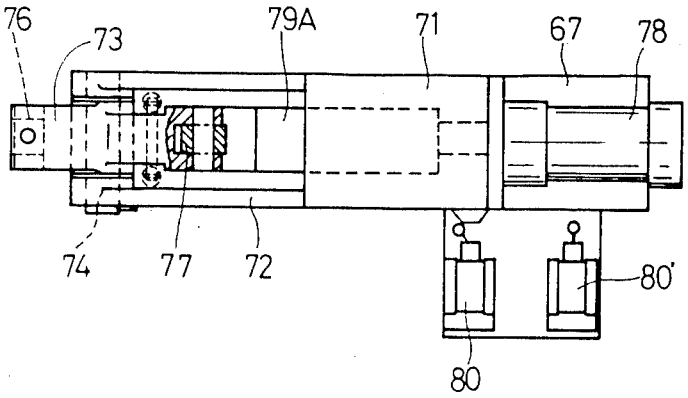

The head end bender means 66 serves to previously bend the wire material in the direction of winding so that the head end of the material may closely contact the outer periphery of the mandrel M. To this end, as shown in FIGS. 12 and 13, the head end bender means 66 is mounted on the same region as the regulating tool 60 of the head end regulator means 56. A movable body 71 with suitable bending means is mounted to a support frame 67 secured to the forward end of the elevating pedestal 10 and is reciprocatable in the direction intersecting the line of feed. The support frame 67 includes two guide levers 68 disposed in a direction perpendicular to the line of feed, and an actuating cylinder 69 mounted to the backside thereof. The movable body 71 is carried by the guide levers 68 and connected to a cylinder 69 with a rod 70. The movable body 71 also includes a pair of bending arms 73 provided between two support plates 72 projecting forwardly therefrom.

The arms 73 are pivotally carried by an upper and a lower support shaft 74 mounted on the support plates 72, and are biased by a spring 75 normally to their released position. The arms 73 have, at their forward ends, wire clamp halves 76 and, at thier rearward ends, rotors 77 for guiding the opening and closing thereof. The opening and closing means of the arms 73 includes an actuating cylinder 78 provided on the upper end of the movable plate 71 and having a rod 79 connected to an actuating bar 79A. The forward end of the actuating bar 79A is projected into and retracted from the rotors 77, and the arms 73 are opened and closed by the movement of the actuating bar 79A.

With this arrangement provided in the head end bender means 66, the cylinders 69 and 78 are brought into an inoperative condition before the head end of the wire material is regulated and upon retracting movement of the movable body 71, the arms 73 are moved into an inactive position outside the line of feed as they are in their release position. After the head end of the wire material is regulated, the cylinders 69 and 78 cooperate, in timed relationship with the upward retracting movement of the regulating tool 60 of the head end regulating means 56, to advance the movable body 71 and thence the arms, while in the released position, into an operative position aligned with the line of feed. Thereafter, the clamp halves 76 hold and bend the head end of the wire material. It is to be noted that the clamp halves 76 are replaceable in accordance with the type of wind, right-hand or left-hand. Reference numerals 80 and 80′ designate sensors for confirming the shifted position of the movable body 71.

Figure 14:
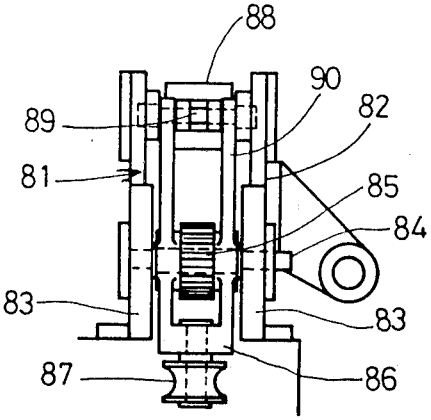
FIGS. 14 and 15 are front and sectional side views, respectively, of the guide means.
Figure 15:
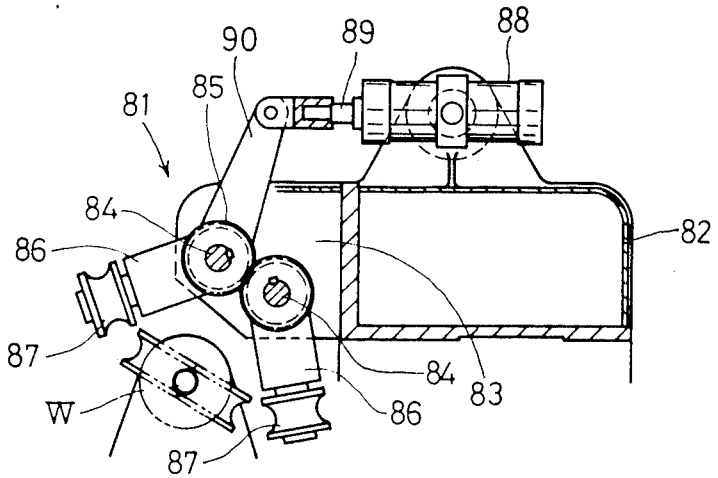

The feed guide means 81 serves to guide the wire material in front of the head end regulator means 56. To this end, as shown in FIGS. 14 and 15, the guide means 81 includes a stationary block 82 fixedly connected to the front end of the support base 26. The stationary block 82 includes a pair of support plates 83 between which a pair of pivotal shafts 84 are supported. The pivotal shafts 84 are coupled by a gear train 85, and each pivotal shaft 84 is connected to a support bar 86 to which a roller 87 is pivotally supported. One of the rotary shafts 84 (or alternatively one of the support bars 86) is connected to a rod 89 of an air cylinder 88 mounted on the stationary block 82 through an arm 90. Thus, upon synchronous pivotal movement of the pivotal shafts 84, the rollers 87 are actuated between a guiding position captively receiving the wire material and an inactive position outside the line of feed. The rollers 87 are of the same configuration as the rollers 24 in the first feeder means 18.

Figure 16:
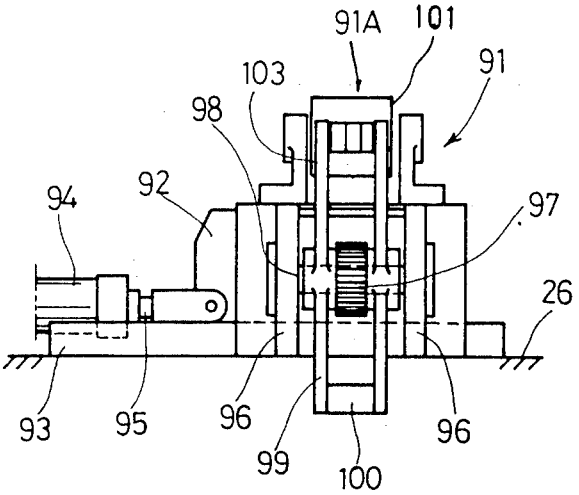
FIG. 16 is a front view of the clamp and feed-out means.

Extending generally above the second feeder means 25 is the clamp and feed-out means 91 which serves to positively direct the wire material which has been regulated by the head end regulator means 56 to a predetermined chucking position of the mandrel. To this end, as shown in FIGS. 7 and 16, the clamp and feed-out means 91 includes a carriage 92 disposed on the support base 26 and provided with a clamp mechanism 91A. Specifically, the carriage 92 is supported on a rail 93 mounted on the support base 26 along the line of feed, and is operatively connected to a rod 95 of an actuating cylinder 94 carried on the support base 26, so as to be reciprocated a predetermined stroke along the direction of the line of feed.

The clamp mechanism 91A is constructed in the same manner as the guide means 81. Specifically, a pair of rotary shafts 98 are supported between support plates 96 secured to the front side of the carriage 92; and are coupled by a gear train 97. Each of the rotary shafts 98 has a support arm 99 on which is provided a clamp half 100 for clamping the wire material. One of the rotary shafts (or alternatively one of the arms 99) is connected to an air cylinder 101 with a rod 102 mounted on the carriage 92 through a connection arm 103. Thus, upon actuation of the air cylinder 101, the arms 98 are closed and opened between an operative position holding the wire material and a released position.

It should be noted that in the clamp and feed-out device 91, the clamp halves 100 of the arms 99 clamp the wire material relatively lightly under the influence of a predetermined pressure developed by the cylinder 101. Thus, when the carriage 92 has been advanced through a predetermined stroke and the head end of the wire material retained at the chucking position of the mandrel M, a moderate slipping action will take place between the wire material and the clamp halves 100 to virtually complete the feed-out operation or restrain undue feeding so that any possible deformation of the wire material may be precluded.

Figure 17:
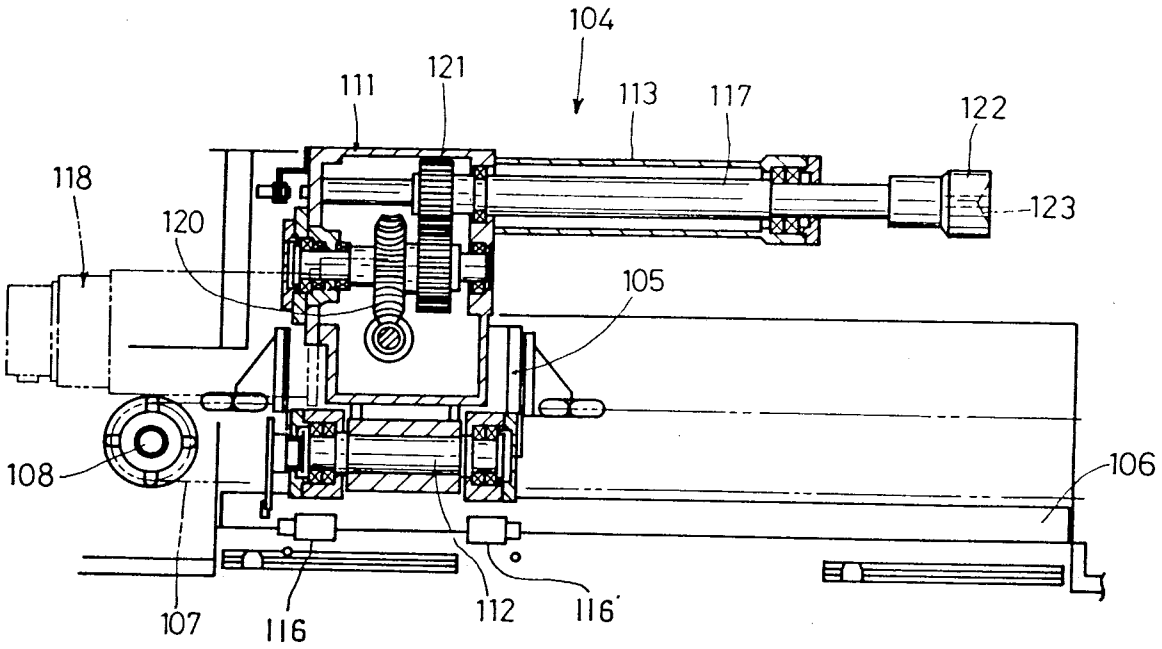
FIGS. 17 and 18 are sectional front and sectional side views, respectively, of the tail-end regulator means.
Figure 18:
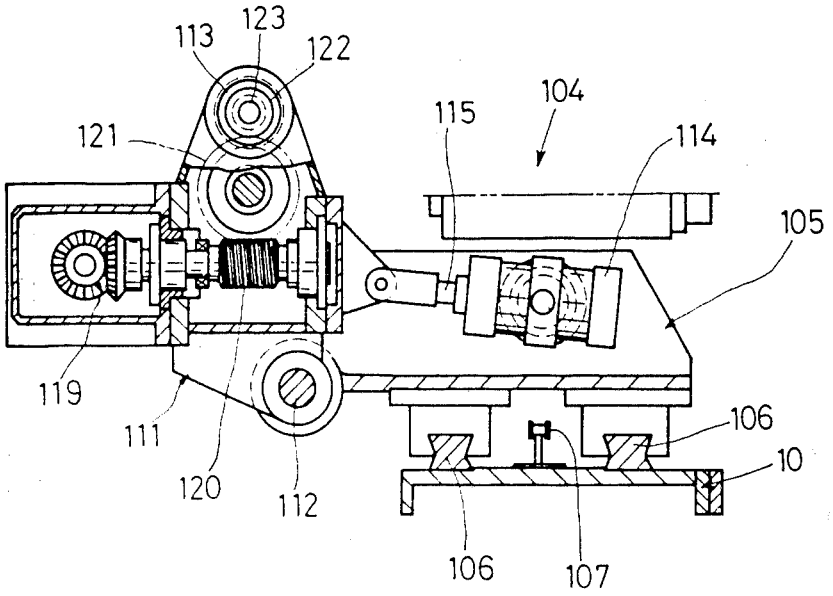

Disposed generally opposite of the first feeder means 25 is the tail end regulator means 104. The task of the means 104 is to regulate the orientation of the remaining unwound portion of the wire material, especially the rolled tail end portion W2, so as to correct possible twist of the wire material in the circumferential direction during the winding operation. To this end, as shown in FIGS. 2, 17 and 18, the tail end regulator means 104 includes a carriage 105 disposed on the elevating pedestal 10, and the carriage 105 has a tiltable body 111 which in turn has a drive means for a regulating tool 122 which will hereinafter be more fully explained. The carriage 105 is supported on a rail 106 mounted on the top surface of the elevating pedestal 10 and along the line of feed. The carriage 105 is adjustably connected to a reciprocating chain 107 which is also mounted on the elevating pedestal 10 so as to be reciprocated through a predetermined stroke along the line of feed. The chain 107 engages with one sprocket, the shaft 108 of which is coupled through a gear train 110 to a control motor 109 disposed at the back of the elevating pedestal 10 (FIG. 3) and adapted to function as will hereinafter be described in greater detail.

The tiltable body 111 is supported by a fulcrum shaft 112 provided on the front underside of the carriage 105 and is tiltable in a direction intersecting the line of feed. The tiltable body 111 includes at the upper end thereof a support sleeve 113 extending parallel to the line of feed toward the mandrel M; and at the lower end thereof a control motor 118 which will be described below in greater detail. Additionally, the tiltable body 111 is connected to a cylinder 114 with a rod 115 carried on the carriage 105 and upon actuation of the cylinder 114, is selectively held between an inoperative position being tilted outside the line during the wire feeding and an operative position upstanding in alignment with the line at a predetermined time during the wire winding. Reference numerals 116 and 116′ designate sensors for confirming the shifted position of the carriage 105 and adapted, when turned on, to stop the motor 109.

The tiltable body 111 further includes a rotary shaft 117 for a regulating tool. The rotary shaft 117 is horizontally carried in the sleeve 113 and is operatively connected at its rearward end to a control motor 118 through a bevel gear train 119, a worm gear train 120 and a spur gear train 121 for rotational movement in either direction (forward and reverse) at a selected speed. The rotary shaft 117 has a regulating tool 122 mounted on the forward end thereof. The regulating tool 122 has on its forward end face a regulating mouth 123 to regulate the rolled tail end portion W2 which will be aligned with the line of feed as soon as the tiltable body 111 has been shifted into the operative position.

Figure 19:
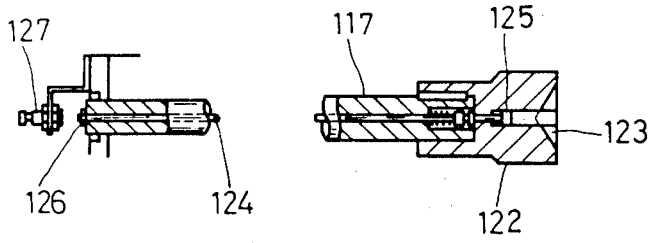
FIG. 19 is a sectional front view of the sensor means used in the tail end regulator means.

The rotary shaft 117 and the regulating tool 122 incorporate a sensor means which is utilized to ascertain as to whether the regulating tool 122 has properly positioned and regulated the rolled tail end portion W2. As best seen in FIG. 19, the rotary shaft 117 has a movable sensing bar 124 extending therewithin and normally biased forward against the regulating tool 122. The sensing bar 124 has at its forward end a sensing portion 125 disposed at a predetermined position within the regulating mouth 123. The sensing bar 124 also has at its rearward end an operating portion 126 which is spaced in rightward (as viewed in FIG. 19) concentric relationship to a sensor 127 mounted on the rearward upper end of the tiltable body 111 and electrically connected to the control motors 109 and 118. With this arrangement, as soon as the regulating tool 122 has regulated the rolled tail end portion W2 as specified, the sensing bar 124 will move leftwardly, as viewed in FIG. 19, thereby to actuate the sensor 127 and effect controlled drive of the motors 109 and 118.

The tail end regulator means 104 is operated on the basis of rotation of the mandrel M and in accordance with the forming conditions of the spring to be wound, for example, such as the length and diameter of the wire material, the angle of wind, and the outside diameter and free height of the spring. The setting particulars of the respective driving components will be described. First, the cylinder 114 is so set as to be actuated at such time T as the mandrel M has wound up a required length of the wire material (for example, such time as the mandrel M has completed N times of rotation or reached a predetermined total rotational angle, $N \times 360°$, from the reference 0° position chucking the wire material). Thereupon, the tiltable body 111 will be brought into its operative position. Second, the control motor 109 on the carriage 105 is so set as to be started in suitably timed relationship with the cylinder 114 and is variably driven in response to the sensing operation of the sensor 127. Thus, upon forward movement of the overall carriage 105 and tiltable body 111, the regulating tool 122 is advanced to trace the tail end of the wire material being wound. Thereafter, during the tail end regulating operation (during the sensor 127 operation), the carriage 105 and hence the regulating tool 122 are advanced at a speed equal to or slightly higher speed than the winding speed of the mandrel M.

Figure 43:
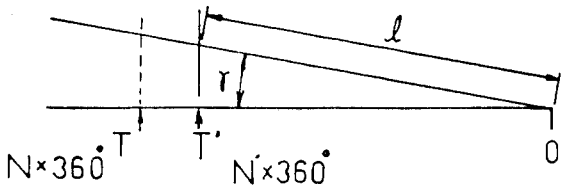
FIG. 43 is a schematic diagram illustrating the regulation of twist of wire material.
Figure 45:
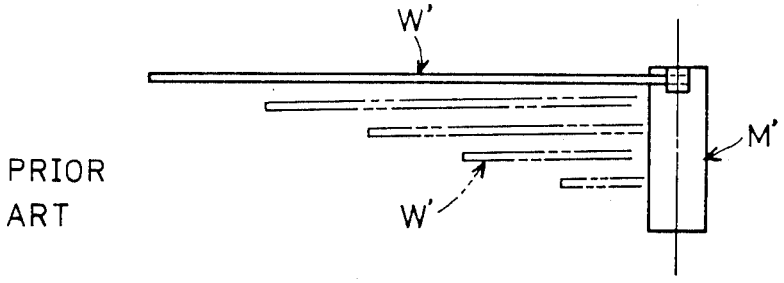
FIG. 45 is a schematic plan view of the prior art method.

Further, the motor 118 on the tiltable body 111 is so set as to be started in timed relationship with the motor 109 at the time T when the mandrel M has wound up a required length of wire material (or when the total rotational angle, $N \times 360°$, has been reached). By means of this setting, the regulating tool 122 is advanced as it is rotated at constant speeds in a predetermined direction to probe the rolled tail end portion W2. Thereafter, the motor 118 will be driven at reduced speeds as soon as the sensor 127 has sensed the wire tail end being regulated by the regulating tool 122, or at such time T' as a predetermined total rotational angle (for example, $N' \times 360°$) for twist regulation has been reached. The regulating tool 122 will then be rotated at slow speeds a sufficient angle to suit the angle $\gamma$ of twist in the peripheral direction of the wire material, which twist will necessarily be developed before the remaining portion or unwound length l of the wire material has been wound. The degree of "twist" is estimated by a certain target value based on the size and/or the winding conditions of a spring to be formed, along with various experimental data. There is little error in regarding the angle of twist $\gamma$ as being uniform and varying in linear proportion to the unit length of the remaining portion l of the wire material, and such errors may be deemed as allowable errors (FIG. 43).

Figure 20:
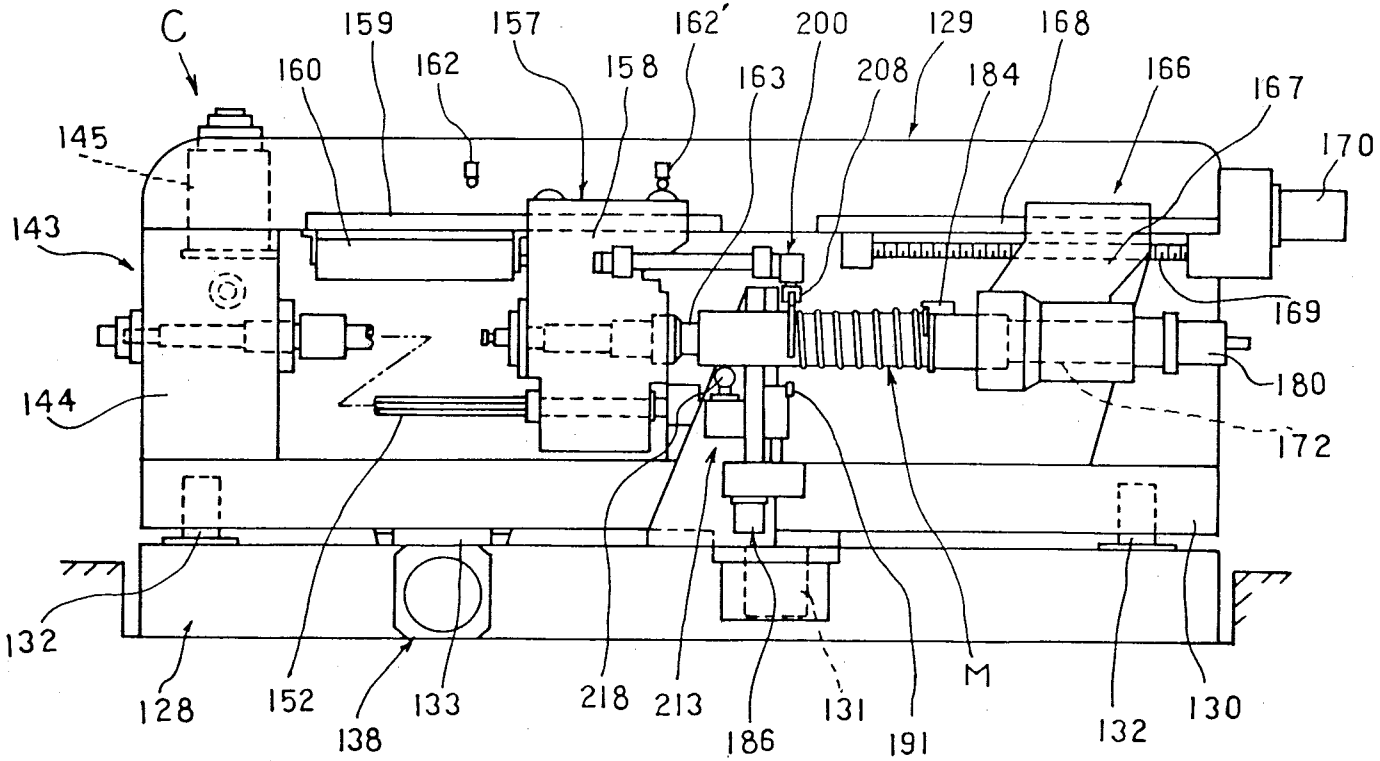
FIG. 20 is a front view of the coil wind section.

Referring now to FIG. 20 in which the wind section C is schematically shown and as may be seen, the wind section C includes a swivel base 129 forming the section body, drive means 143 and first and second movable holder means 157 and 166 for the mandrel M, and wind guide means 186 and tail end hold-down means 200 for the wire material.

Figure 21:
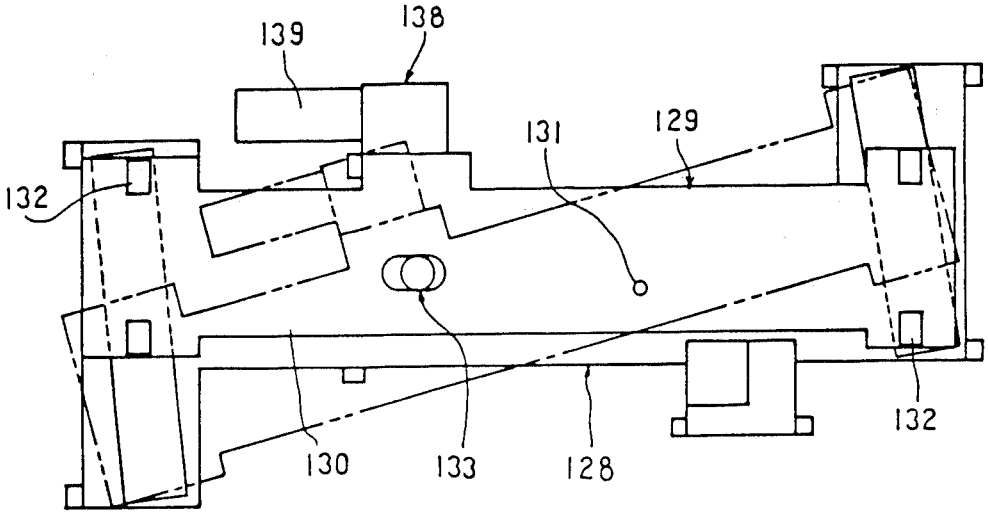
FIG. 21 is a plan view of the swivel base.
Figure 22:
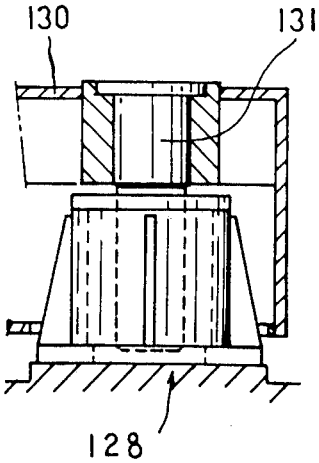
FIG. 22 is a sectional side view of the fulcrum shaft of the swivel base of FIG. 21.
Figure 23:
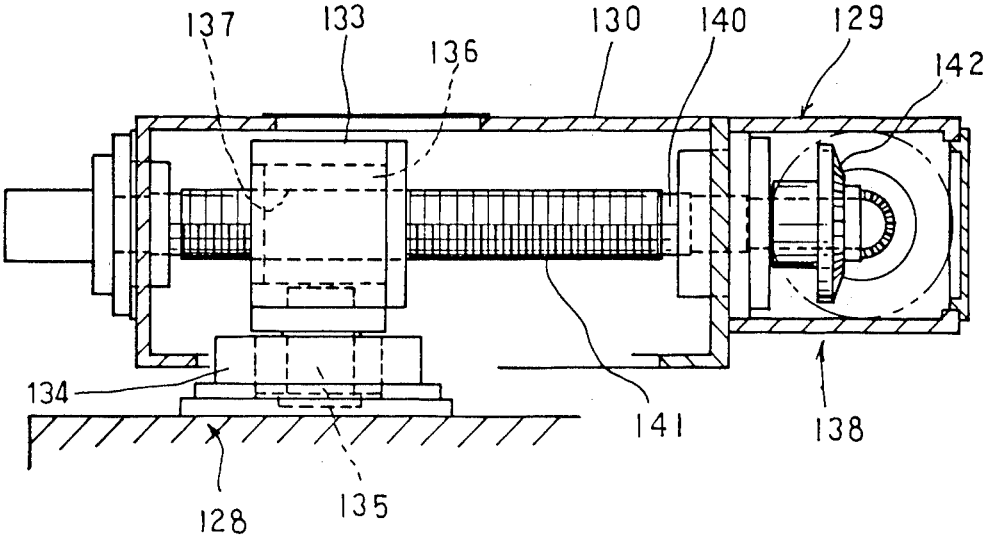
FIG. 23 is a sectional side view of the swivel means.

The swivel base 129 serves to move the mandrel M a required wind angle relative to the wire material W on the line of feed. To this end, as shown in FIGS. 21 and 22, the swivel base 129 includes a subbase 130 carried on a fixed base 128 through a fulcrum shaft 131 and wheels 132. The swivel base 129 is operated by a later described swivel means 138 which is operatively connected to a coupling point 133 on the fixed base 128. The coupling point 133 is located underneath the subbase 130 and is supported by a holder 134, as shown in FIG. 23. The holder 134 includes a coupling shaft 135 which is pivotally and displaceably supported therein. The coupling point 133 includes a coupler 136 having a threaded hole 137 and fixedly connected to the coupling shaft 135.

Figure 24:
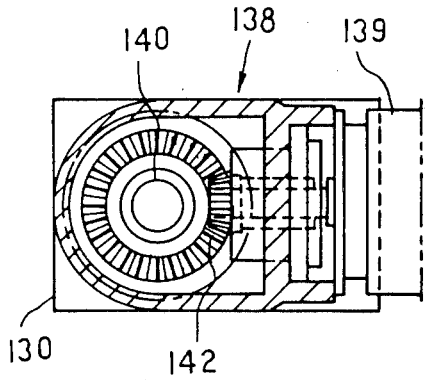
FIG. 24 is a sectional view of the drive of the swivel means of FIG. 23.
Figure 27:
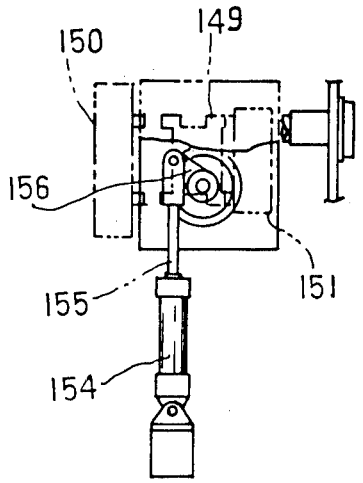
FIG. 27 is a sectional view of the control of the clutch shifting mechanism of the drive means.

As shown in FIGS. 23 and 24, a swivel means 138 is mounted to the swivel base 129 and includes a rotary feed shaft 140 operatively connected through a bevel gear train 142 to a control motor 139 mounted on the subbase 130 of the swivel base 129. The rotary feed shaft 140 has a threaded shaft 141 threadably inserted into the threaded hole 137 of the coupler 136. Upon forward and reverse drive of the motor 139, therefore, the feed shaft 140 is advanced and retracted for displacement relative to the coupler 136, and such displacement causes the swivel base 129 to pivot about the fulcrum shaft 131. Thus, both before and after the winding operation, the swivel base 129 is held in a reference position (angle 0) perpendicular to the plane of the line of feed, and during the winding operation, the swivel base 129 may pivot and shift steplessly (or possibly in a stepped manner) into a predetermined winding position (angle $\beta$, $\gamma$) within acute angles relative to the reference position. It is to be noted that the fulcrum shaft 131 to effect the specific pivotal movement is located at the intersection of the line of feed and the reference position.

Figure 44A:
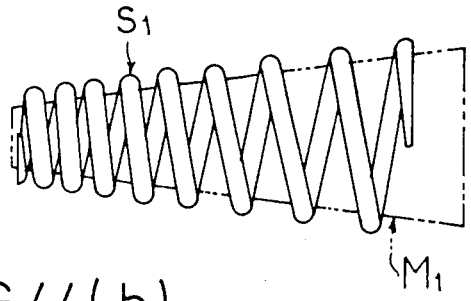
FIGS. 44(*a*)–44(*c*) are schematic representations illustrating various springs and mandrels.
Figure 44B:
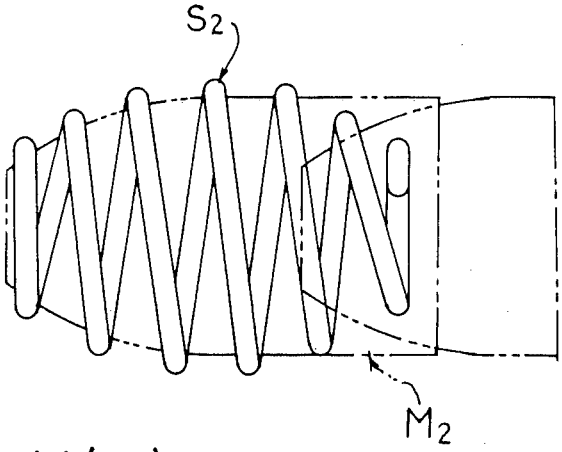
Figure 44C:
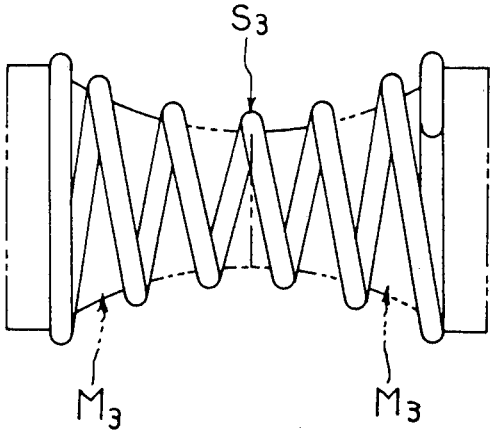

The mandrel M is operated through numerical controls for its reorientation of the winding position by means of pivotal movement of the swivel base 129; for its rotational movements commensurate with the type of springs, right-hand wind or left-hand wind; and for its travel in an axial direction. A selected mandrel M commensurate with the shape and size of springs to be formed is removably disposed between a first and a second movable holder means 157 and 166 which will hereinafter be described in greater detail. FIGS. 44(*a*), 44(*b*) and 44(*c*) represent various types of the mandrel M, conical, semispindle-shaped and hand drum-shaped, which may be used in the apparatus of the present invention.

The drive means 143 for the mandrel M has a casing 144 secured to one end (the left-hand end as viewed in FIG. 20) of the swivel base 129. A control motor 145, a spindle 146 and a driven shaft 148 are provided within the casing 144, as shown in FIGS. 25 and 26. The spindle 146 and the driven shaft 148 are operatively connected to a spline shaft 152, and are variable in two speeds, low and high. The spindle 146 is horizontally supported on the central portion of the casing 144 in a direction perpendicular to the plane of mandrel M, and is operatively connected to a motor 145 mounted on the top of the casing 144 through a chain train 147. The driven shaft 148 is operatively supported in parallel relationship with the spindle 146 and at the same time is coupled to the spindle 146 through a low speed and a high speed gear train 150 and 151 which are selectively operated by a clutch 149. The driven shaft 148 is also coupled to the spline shaft 152 horizontally supported in the center of the swivel base 129.

The motor 145 is of the reversible type and effective to rotate the mandrel M in either direction at a desired speed. Additionally, the high speed gear train 150 refers to that large gear on the spindle 146 and that small gear on the driven shaft 148, as shown on the left in FIG. 26. Also, the low speed gear train 151 refers to that small gear on the spindle 146 and that large gear on the driven shaft 148, as shown on the right in FIG. 26. To operate the clutch 149, a cylinder 154 is provided outside the casing 144, having a rod 155 connected to a shift lever 156 which in turn is pivotally supported by the casing 144 and coupled to the clutch 149 through a suitable means. Thus, the upward and downward movement of the rod 155 of the cylinder 154 causes the clutch 149 to slide along the driven shaft 148 into engagement with gear trains 150 and 151.

Figure 28:
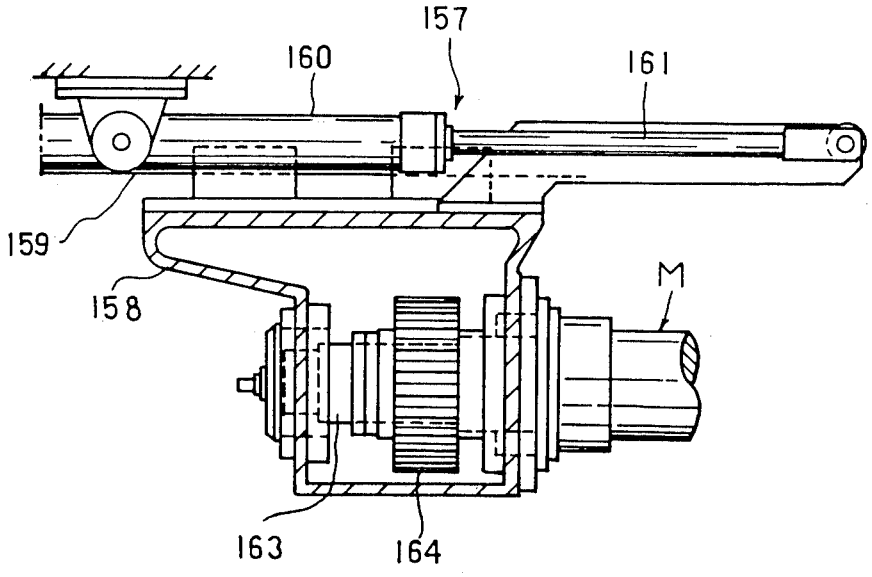
FIGS. 28 and 29 are sectional front and plan views, respectively, of the first movable holder means of the mandrel.
Figure 29:
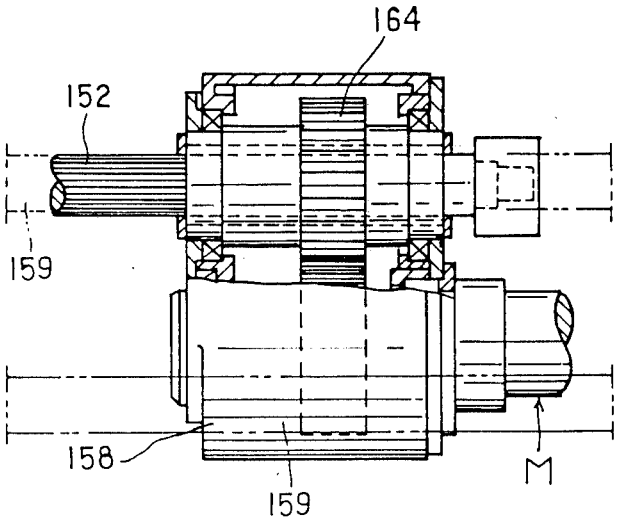

The first movable holder means 157 serves to removably hold the base portion of the mandrel M. To this end, as shown in FIGS. 28 and 29, the first movable holder means 157 includes a movable body 158 disposed within the swivel base 129, which movable body 158 has a horizontally extending connecting spindle 163 for the mandrel M. The movable body 158 is carried on and dependent from a rail 159 horizontally mounted on the upper portion of the swivel base 129 and receives the spline shaft 152 therein. The movable body 158 is reciprocated a predetermined distance (a required amount of travel of the spindle M) through actuation of a cylinder 160 mounted below the rail 159. The cylinder 160 has a rod 161 connected to the movable body 158 at its rearward end and is controlled for its operating speed and operating amount through a hydraulic control mechanism (not shown). Reference numerals 162 and 162' indicate sensors which are arranged at the respective ends of travel of the movable body 158.

Figure 30:
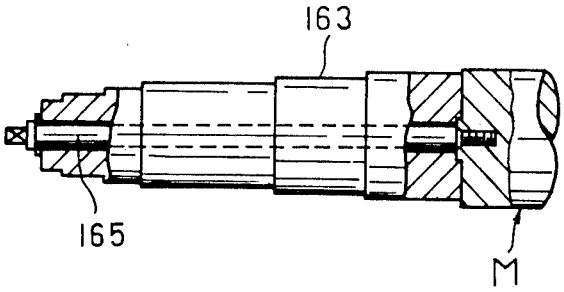
FIG. 30 is a front view of the connection of the mandrel.

The connecting spindle 163 serves to removably connect the mandrel M for rotational movement therewith. The connecting spindle 163 is removably supported centrally in the movable body 158 and is aligned with the mandrel M on the same line. The connecting spindle 163 is coupled to the spline shaft 152 through a spur gear train 164 for forward and reverse rotation. With reference to FIG. 30, the connecting spindle 163 is connected to the mandrel M in such a manner that with the end faces aligned with each other, the forward end of a threaded connecting bar 165 received coaxially within the connecting spindle 163 is threadedly engaged with a threaded hole formed at the rearward end of the mandrel M.

Figure 31:
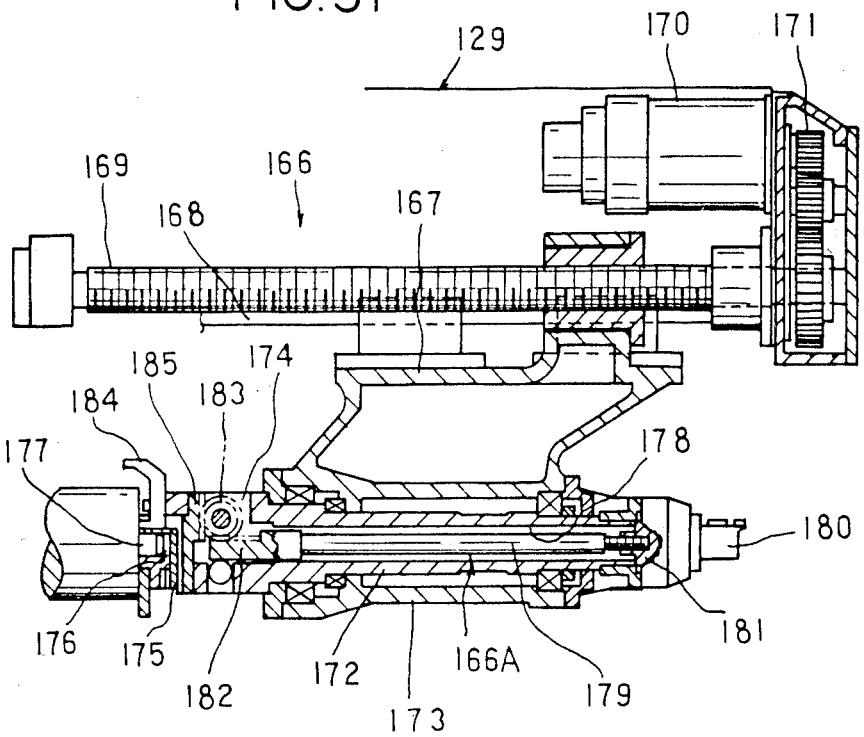
FIGS. 31 and 32 are sectional front and side views, respectively, of the second movable holder means of the mandrel.
Figure 32:
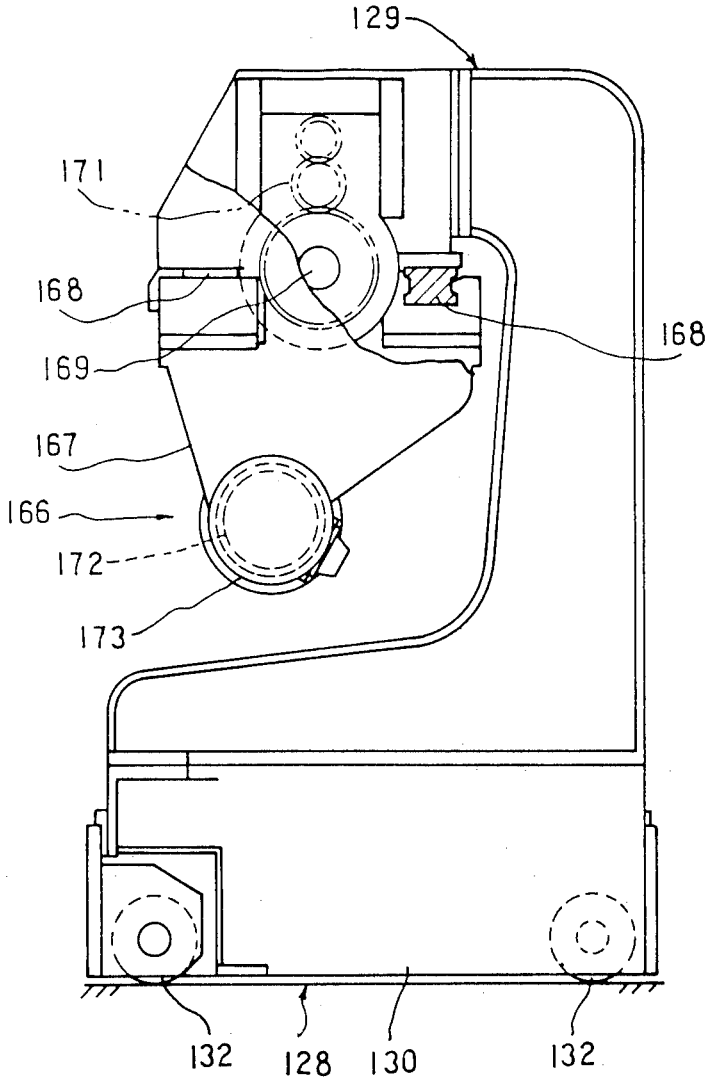

The second movable holder means 166 serves to separably hold the extremity of the mandrel M. To this end, as shown in FIGS. 31 and 32, the second movable holder means 166 includes a movable body 167 disposed within the swivel base 129, which movable body 167 has a mandrel-connecting driven shaft 172 which in turn incorporates a chucking mechanism 166A therein. The movable body 167 is carried on and dependent from a rail 168 horizontally mounted on the upper portion of the swivel base 129. The movable body 167 is threadedly engaged with and supported by a feed shaft 169 horizontally extending below the rail 168. Upon rotational movement of the feed shaft 169, therefore, the movable body 167 is reciprocated a predetermined distance in timed relationship with the movable body 158 of the first movable holder means 157. The feed shaft 169 is coupled to a control motor 170 mounted on the upper rear side of the swivel base 129 through a spur gear train 171, and is rotatable in either the forward or reverse direction on the basis of controlled drive of the motor 170.

The connecting driven shaft 172 is driven with the mandrel M and is of cylindrical shape. The shaft 172 is inserted into and supported by a support sleeve 173 secured to the lower portion of the movable body 167, and is aligned with the mandrel M on the same line. The shaft 172 is provided at its forward end with a recess 174 for receiving a gear, and with a carrier plate 175 removably secured thereto for receiving a chuck. The connection of the shaft 172 with the mandrel M is such that an engagememt hole 176 formed in the forward end of the shaft 172 is separably engaged with an engagement shaft 177 provided at the extremity of the mandrel M.

Figure 33:
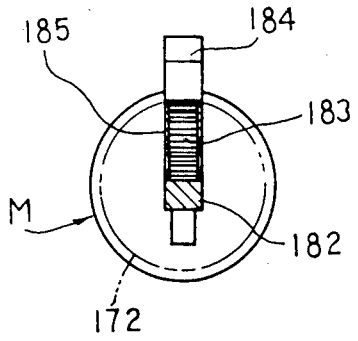
FIG. 33 is a side view of the chuck.

The chuck mechanism 166A carried in the driven shaft 172 includes an operating bar 179 received in a shaft hole 178 of the driven shaft 172, as shown in FIGS. 31 and 33. The operating bar 179 is connected to a cylinder 180 with a rod 181 mounted on the rearward end of the driven shaft 172. A rack 182 formed on the forward end of the operating bar 179 engages a pinion 183 pivotally mounted within the recess 174. A chuck 184 removably mounted on the carrier plate 175 is coupled to the pinion 183 through a rack 185 and is actuable between its open and closed positions. The rack 185 is disposed perpendicular to the rack 182 of the operating bar 179 secured to the chuck 184. The chuck 184 is located on the same vertical line as the point of pivot (the fulcrum shaft 131) before winding the wire material (before advancing the mandrel M), and is placed in either a predetermined upper peripheral or lower peripheral position of the mandrel M, depending on the direction of wind, right hand or left hand.

It is to be noted that in the first and second movable holder means 157 and 166, both the movable bodies 158 and 167 are variable in speed through the controlled actuation of the cylinder 160 and the motor 170. For advancement of the mandrel M, the movable bodies 158 and 167 are moved forwardly in synchronism with one another; and for retracting movement of the mandrel M, the movable body 158 is returned suitably faster than the movable body 167. By means of this arrangement, the mandrel M may be separated from the connecting driven shaft 172 as it is pulled back by the connecting spindle 163.

Figure 34:
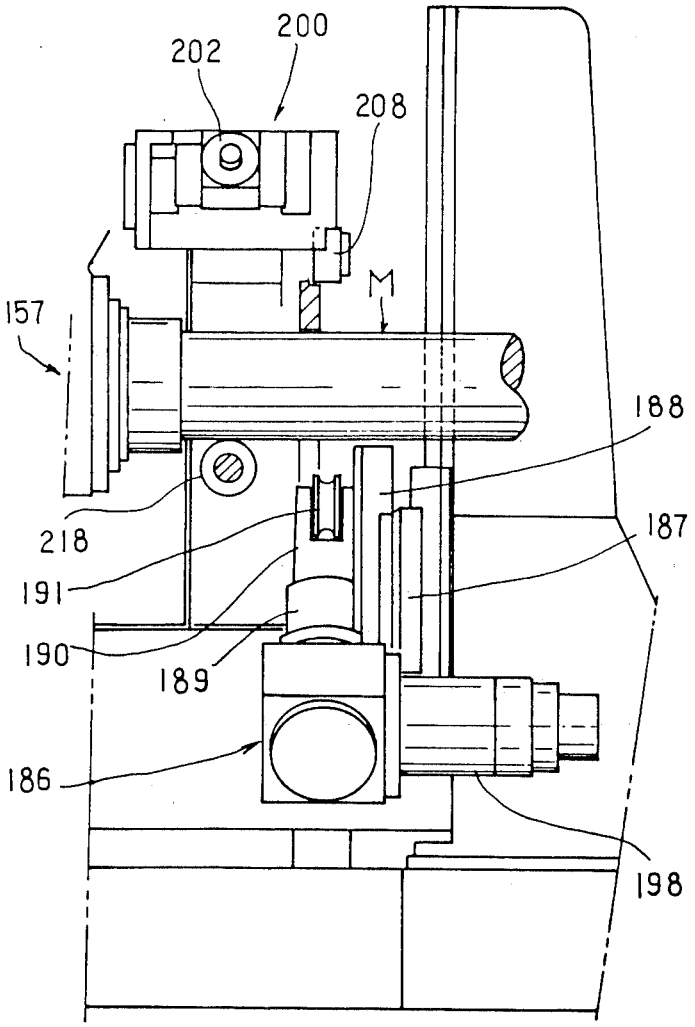
FIGS. 34 and 35 are front and sectional side views, respectively, of the wind guide means and the tail end hold-down means.
Figure 35:
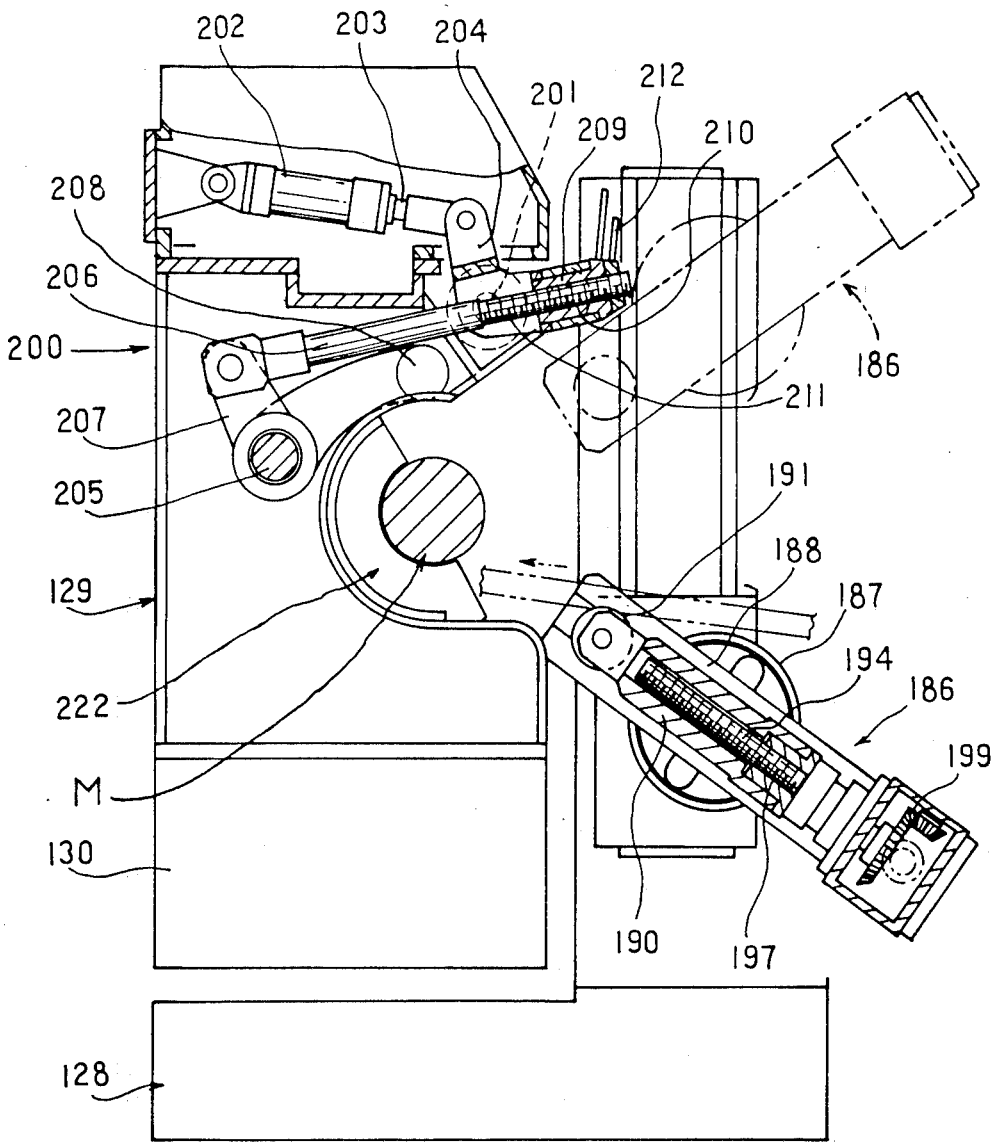

The wind guide means 186 serves to wind the wire material during the winding process. As shown in FIGS. 34 and 35, two means 186 are provided and located radially symmetrically above and below the mandrel M in predetermined positions before the mandrel M or in front of the feed guide means 81 of the feed section F. The two means 186, being selectively used for either right-hand or left-hand wind, are constructed the same way. For the purpose of illustration, only one means 186 (for right-hand wind shown below in FIG. 35) will be described. The wind guide means 186 includes a holder 188 mounted slantingl on a carrier plate 187 provided centrally in front of the swivel base 129. A support sleeve 190 is inserted in a cylindrical portion 189 of the holder 188 and a roller 191 is replaceably carried by the bifurcated portion of the support sleeve 190.

Figure 36:
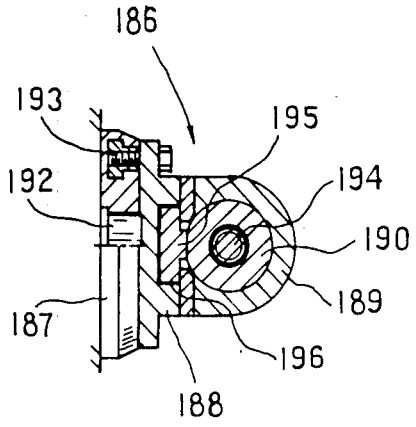
FIG. 36, is a sectional view of the support of the wind guide means.

For setting a roller 191 at the proper angle and position in view of the diameter of wire material and/or the diameter of wind, the holder 188 is tiltably located relative to the carrier plate 187 by means of a fulcrum pin 192 and a regulating fastener 193, as shown in FIGS. 35 and 36. The support sleeve 190 is supported by a threaded shaft 194 carried within the holder 188. Thus, the forward and reverse rotations of the threaded shaft 194 causes the support sleeve 190 to move toward and away from the mandrel M through a sliding piece 195 along a guide way 196 formed in the holder 188. The threaded shaft 194 is threadedly received in a threaded hole 197 of the support sleeve 190 and is rotatably connected through a bevel gear train 199 to a control motor 198 mounted on the lower end of the holder 188. It is to be noted that in the wind guide means 186 thus constructed, the roller 191 receives the upper surface of the wire material, while in the other means 186 shown above in FIG. 35, the roller 191 receives the lower surface of the wire material. In either means 186, the respective roller 191 is positioned for its specific guiding operation commensurate with the configuration and outside diameter of the wire material. Additionally, the roller 191 is held in a fixed position with respect to a straight circular mandrel; and is progressively displaced with respect to a conical and/or a semispindle-shaped mandrel.

Figure 37:
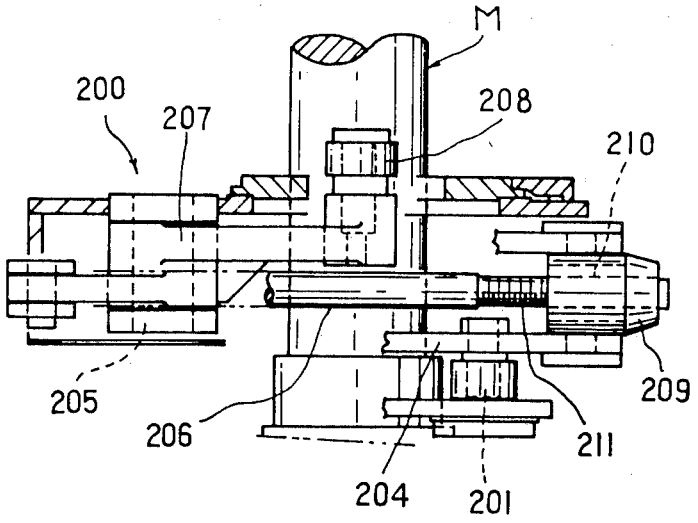
FIG. 37 is a plan view of the tail end hold-down means.

The tail end hold-down means 200 serves to closely press the tail end of the wire material against the outer periphery of the mandrel M. As shown in FIGS. 34, 35 and 37, the means 200 is located at the back of the mandrel M and in alignment with the line of feed. Specifically, the means 200 includes a first L-shaped lever 204 pivotally supported by a support shaft 201 mounted on the upper portion of the swivel base 129 and connected to a cylinder 202 with a rod 203 also mounted on the upper portion of the swivel base 129; a second L-shaped lever 207 pivotally supported by a support shaft 205 located centrally in the swivel base 129 and connected to the first L-shaped lever 204 through a connecting bar 206; and a roller 208 connected to the other end of the lever 207 and aligned with the line of feed. Thus, upon actuation of the cylinder 202, the rod is moved to cause the roller 208, through levers 204 and 207 and the connecting bar 206, to move in the diametral direction of the mandrel M between a material unclamping position and a pressing position.

For controlling the displacement of the roller 208, in accordance with the parameters such as the diameter of the wire material and the outside diameter of the spring to be formed, the connection of the first L-shaped lever 204 with the connecting bar 206 is such that a threaded shaft 211 formed at the other end of the connecting bar 206 is threadably received in a threaded hole 210 formed in a rotation regulator 209 mounted on the other end of the first lever 204. The rotation regulator 209 is rotated by a handle 210 to cause the connecting bar 206 to vary the point of connection with the first lever 204, that is the distance of connection between the levers 204 and 207. Thereafter, upon tilting movement of the second lever 207, the roller 208 is held in place in the diametral direction of the mandrel M. The tail end hold-down means 200 is normally actuated upon completion of the winding operation; however, it may be actuated immediately after the starting of or during the course of the winding operation.

Figure 38:
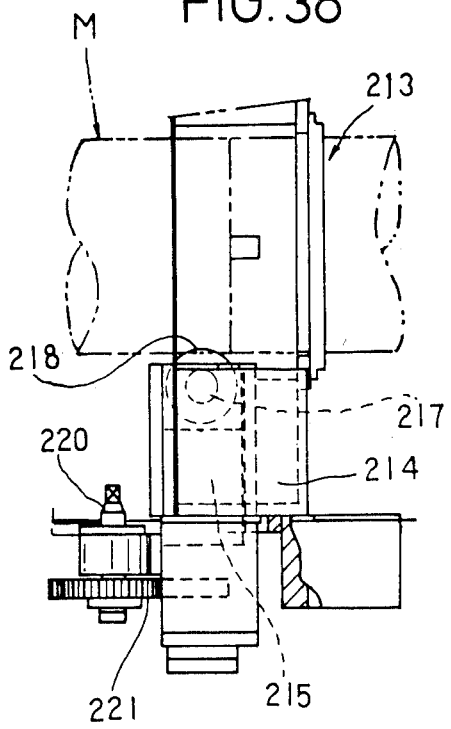
FIGS. 38 and 39 are front and sectional side views, respectively, of the mandrel guide means.
Figure 39:
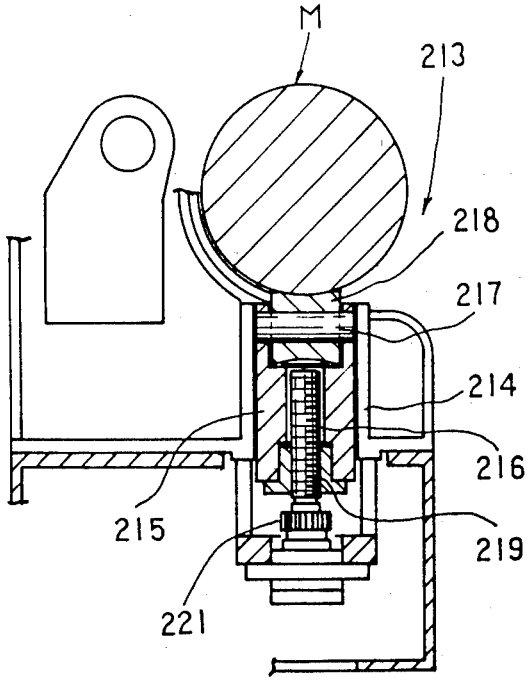

The wind section C further includes a guide means 213 for the mandrel M, and a retaining tool 222 and a transfer device 223 for the final spring. The guide means 213 serves to guide the mandrel and, as shown in FIGS. 38 and 39, includes a support casing 214 which is provided centrally within the swivel base 129 and a support body 215 which is received within the support casing 214 for vertical movement and is adjustable by means of threaded adjusting shaft 216. A roller 218 for bearing the lower periphery of the mandrel M is carried on a support shaft 217 received in the bifurcated portion formed on the top end of the support body 215. The threaded shaft 216 is vertically supported in the support casing 214 and threadably received in a threaded hole 219 formed in the support body 215. The threaded shaft is forward and reverse rotated by an operating shaft 220 through a gear train 221. With this arrangement, therefore, the support body 215 and the roller 218 are controlled to adjust their respective vertical positions. The roller 218 is of hand drum-shaped configuration commensurate with the outer periphery of mandrels of various sizes and shapes, and is replaceable by removing the support shaft 217.

The retaining tool 222 is utilized to retain and remove the formed spring during returning movement of the mandrel M and is provided at the rearward side of the tail end hold-down means 200, as shown in FIG. 35. The retaining tool 222 may be replaceably mounted on a suitable shift member such as a cylinder and shifted between a spring-retaining position and an inoperative position. The transfer device 223 serves to clamp and transfer the spring removed from the mandrel M outwardly of the apparatus. To this end, the transfer device 223 moves a pair of clamps 224 disposed in the midway of travel of the mandrel M rearwardly (rightwardly as viewed in FIG. 1) from the wind section C in a direction perpendicular to the plane of mandrel M.

The present method permits a series of automatic operations ranging from feeding to winding of wire material on the basis of one cycle-one forming operations of the apparatus which incorporates the cooperating arrangement of the feed section F and the wind section C. The present method will now be described with reference to the spring S shown in FIG. 41 which has seats at its opposite ends, and in the order in which the respective means perform the respective operations.

In the feed section F, the elevating pedestal 10 of the frame 1 is actuated longitudinally and vertically relative to the fixed plate 2 by the motor 4 and the cylinder 13 into a predetermined position and inclined height. Thus, all the subassemblies of the feed section F are set in their respective predetermined positions to provide a predetermined elevated line of feed or material advancement toward the mandrel M in the wind section C.

With this condition existing, the first and the second feeder means 18 and 25 and the posture-retaining means 40 are synchronously actuated. Specifically, in the first feeder means 18, the wire material W taken out from the heating furnace H by the operator is received on rollers 24 to be constantly fed in a substantially horizontal plane. (During the course of feeding, however, the wire material is roughly adjusted by the operator for the orientation of its rolled formed end W1.) Thereafter, the posture-retaining means 40 holds the wire material between the guide roller 46 and the hold-down roller 50 so that it will not swing, and feeds the material forwardly while correcting the peripheral direction, especially the orientaion of the rolled forward end W1. The second feeder means 25 feeds the wire material forwardly toward the head-end regulator means 56 as it holds the material between the rollers 29 (FIG. 1(*a*)).

As this occurs, the cylinder 62 in the head end regulator means 56 is actuated to set the regulating tool 60 in its regulating position on the line of feed. After regulating the orientation and position of the rolled forward end W1 by the regulating mouth 61, the cylinder 62 is deactuated to move the regulating tool 60 outwardly upwardly to its inactive position in readiness for the next operation. Upon completion of the regulating operation, the head end bender means 66 will be operated. The cooperating action of the actuating cylinders 69 and 78 of the head end bender means 66 causes the arms 73 to set in the forming position to bend the head end of the wire material in a selected direction through the clamp halves 76. Thereafter, the arms 73 are quickly returned to the inoperative position in readiness for the next operation.

Subsequent to the completion of the wire regulating operation, the guiding operation of the feed guide means 81 and the directing operation of the clamp and feed-out means 91 are initiated. Specifically, the rollers 87 of the support bar 86 are moved into a guiding position to guide the wire material as they hold the material therebetween. The rollers 87 will then be retracted to their inoperative position in appropriate timing. Thereafter, in the clamp and feed-out means 91, the actuation of the cylinder 101 of the clamp mechanism 91A causes the arms 99 to be closed to clamp the material between their clamp halves 100. Then, the actuation of the cylinder 94 causes the carriage 92 to move into a predetermined position along the rail 93 of the elevating pedestal 10, directing the material into the predetermined chucking position on the mandrel M in the wind section C (FIG. 1(*b*)).

It is to be noted that after the clamp and feed-out means 91 holds the wire material and before it directs the material into the chucking position, all the rollers 87 are retracted outwardly of the line of feed through deactuation of the cylinder 88, and prior to the subsequent feed of material, the second feeder means 25 is brought into the feeding position. In addition, the clamp and feed-out means 91 completes its directing operation at the time when the carriage 92 has reached the end of its advancement. As soon as the winding operation of the mandrel M is initiated, the cylinders 94 and 101 are deactuated to thereby release the arms 99 to be returned to the end of their retraction along with the carriage 92 in readiness for the next operation. The operation of the tail end regulator means 104 will hereinafter be explained.

Subsequent to the series of operations performed in the feed section F, the head end of the wire material is chucked at a predetermined position of the mandrel M in the wind section C. The mandrel M will then be operated to wind the material by the aid of respective operations of the swivel means 138, the drive means 143, and the first and the second movable holder means 157 and 166. Specifically, in the chuck means 166A of the second movable holder means 166, the chuck 184 is placed in the predetermined position adjacent the lower periphery of the mandrel M in conformance to the selected direction of wind. Then, the cylinder 180 is actuated to close the chuck 184 through the operating bar 179, the rack 182, the pinion 183 and the rack 185 to thereby firmly secure the head end of the wire material M (FIG. 1(*b*)).

Thereafter, the means 138, 143, 157 and 166 are operated as set. Specifically, in the swivel means 138, the forward rotation of the motor 139 causes the rotary shaft 140 to threadedly advance toward the coupler 136 of the coupling point 133, and thence the swivel base 129 to pivot about the fulcrum shaft 131 into the desired winding position. In the drive means 143, the chuck 149 is shifted to set either the high-speed gear train 150 or the low-speed gear train 151 in place. Then, as soon as the motor 145 is driven, the spindle 146, the driven shaft 148 and the spline shaft 152 are rotated to thereby cause the connecting spindle 163 of the first movable holder means 157 to rotate through the spur gear train 164. In the first and the second movable holder means 157 and 166, the actuation of the cylinder 160 in synchronism with the forward rotation of the motor 170 causes the respective movable bodies 158 and 167 to move forwardly along the rails 159 and 168 at the identical speeds. Thereupon, the mandrel M will be controlled to perform its winding operation commensurate with the forming condition of the springs.

Figure 41:
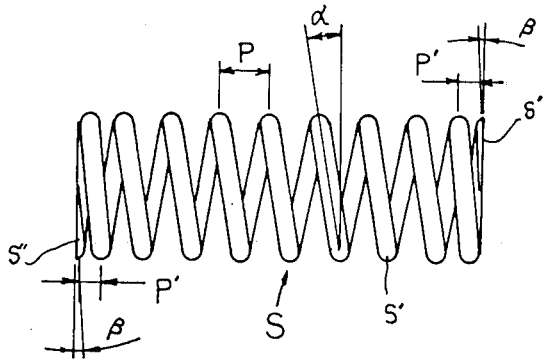
FIG. 41 is a front view of a coil spring.
Figure 42:
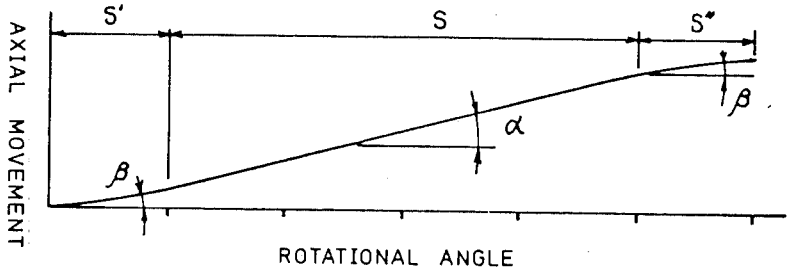
FIG. 42 is a schematic diagram illustrating an example of control of mandrel.

At this point, the control of the mandrel M will be described briefly. As shown in FIG. 41, the angle of wind ($\alpha$) and the pitch (P) at the effective wind portion of a spring S are different from those ($\beta$, P') at the seats s' and s'' at the opposite ends of the spring S. Therefore, as schematically shown in FIG. 42, with the mandrel M rotating at a fixed speed, the angle of wind (orientation) and the speed of advancement of the mandrel M are gradually controlled and varied at the beginning and the end of the wind commensurate with the respective seats s' and s''. On the other hand, in the winding process corresponding to the effective wind portion, both the angle of wind and the speed of advancement of the mandrel M are set to be maintained constant. Therefore, the mandrel M is operated by the respective means 138, 143, 157 and 166 in accordance with the above noted conditions so as to serially wind the wire material M to form the seat s' at the head end, the effective wind portion S and the seat s'' at the tail end in sequence. It is to be noted that in the winding process, the wire material W is guided by the roller 191 of the wind guide means 186 during the travel of the guide means 213.

In the winding process, at the time T when the mandrel M has completed the winding of the predetermined length of a wire material W1 the mandrel M will be operated at slow speeds in accordance with the reduction in speed of drive of the drive means 143 and the first and the second movable holder means 157 and 166. As this occurs, the tail end regulator means 104 in the feeder section F will be operated. More specifically, in the tail end regulator means 104, with the clamp and feed-out means 91 returned to its starting position, the tiltable body 111 is held in its upstanding operative position through the actuation of the cylinder 114. The motor 118 is driven to rotate the rotary shaft 117 through gear trains 119, 120 and 121. Then, the forward rotation of the motor 109 causes the carriage 105 to move forwardly, being pulled by the reciprocating chain 107, along the rail 106 of the elevating pedestal 10. Thereafter, the regulating tool 122 on the extreme end of the rotary shaft 117, being aligned with the line of feed, is rotated and advanced in synchronism with the transit of the wire material W. As the regulating tool 122 traces the tail end of the material, the regulating mouth 123 engages the rolled tail end W2 for the purpose of regulating the orientation.

During the reorientation of the tail end W2, the sensor 127 will be activated to cause the motors 109 and 118 to drive. Specifically, the motor 118 is slowly driven for angle $\gamma$ corresponding to the "twist" produced until the remaining length l of the material has been wound. On the other hand, the motor 109 is driven at the speed commensurate with the speed of wind (the peripheral speed) of the mandrel M. As these occurs, the regulating tool 122 is slowly started in proportion to the proper twist angle $\gamma$, holding the rolled tail end W2 of the material, so as to push out the material in conformance to the speed of wind of the mandrel M (FIG. 43).

Simultaneously with the tail end regulating operation, the mandrel M in the wind section C is controlled so as to be disposed in its normal operating condition. Specifically, the drive means 143 and the first and the second movable holder means 157 and 166 are driven at the speed commensurate with the forming condition of the spring S, in synchronism with the time T when the regulating tool 122 has started its regulating operation (or when the total rotational angle, $N \times 360°$, has been reached). As this occurs, the mandrel M is rotated and moved at the predetermined speed to wind the remaining length l of the wire material. When one winding has been completed, the mandrel M is slowly rotated and moved while directing the center of the winding to its original position by the controlled drive of the swivel means 138, the drive means 143 and the first and the second movable holder means 157 and 166. After the tail end seat s'' has been wound, the mandrel M is returned to the reference position and then stopped at the end of its advancement to complete the required wire winding operation (FIG. 1(*d*)).

Subsequent to the wire winding operation, the sensor 127 in the tail end regulator means 104 will be turned off as soon as the wire material moves away from the regulating tool 122. Upon reversal and stopping of the motor 109, the carriage 105 will be retained at the end of its retraction. Upon deactuation of the cylinder 114 the tiltable body 111 will be held in its tilted position, and upon stopping of the motor 118, the rotary shaft 117 will be stopped. As this occurs, the regulating tool 122 is returned to its retracted, inactive position in readiness for the next operation. On the other hand, at the time when the winding operation has been completed, the operation of the tail end hold-down means 200 is initiated. Specifically, in the tail end hold-down means 200, the actuation of the cylinder 202 causes the hold-down roller 208 to be set in its operative position through the first and second levers 204 and 207. Then, the hold-down roller 208 suitably holds and guides the end portion of the wire material to closely contact the wire material with the outer periphery of the mandrel M. Thereafter, upon deactuation of the cylinder 202 in timed relationship with the completion of the winding operation, the hold-down roller 208 is returned to its released position in readiness for the next operation.

After completion of the above-mentioned winding operation, the overall wind section C is returned to its original position. Specifically, in the drive means, the reverse rotation of the motor 145 causes the spline shaft 152 and the spindle 163 of the first movable holder means 157 to rotate in the reverse direction; in the first movable holder means 157 the actuation of the cylinder 160 causes the movable body 158 to be swiftly retracted to its original position along the rail 159 and the spline shaft 152; and in the second movable holder means 166, the slow reverse drive of the motor 170 causes the movable body 167 to be slowly retracted along the feed shaft 169 and the rail 168. Thereafter, due to the difference in the retracting speed existing between the first and the second movable holder means 157 and 166, the mandrel M is removed from the driven shaft 172 in the second means 166, being held by the connecting spindle 163 of the first means 157, and is returned to its original position as it is guidingly held by the roller 118 of the guide means 213, with the chucking position returning to its original position. It is to be noted that the drive means 143 may be reverse driven for a desired time after retraction of the mandrel M.

In the retraction process of the mandrel M, the formed spring S is removed from the mandrel M by the retaining tool 222 and then clamped by the transfer device 223 to be transferred to an external apparatus such as a transfer conveyor. Next, in the second movable holder means 166, the movable body 167 is returned to its original position in timed relationship with the transfer device 223. Again, the connecting driven shaft 172 is coupled to the mandrel M in readiness for the next wire winding operation, along with the first movable holder means 157 (FIG. 1(*e*)).

Thereafter, in the same manner as previously desired, the cyclic operation of the respective means in feed section F and the wind section C permits the wire material to be fed and regulated as it is aligned with the selected line of feed at all times; and the mandrel M to be pivotted into a predetermined winding position as it is rotated and moved so as to form a spring S.

It will now be understood that according to the present invention, various types of springs may be formed, as schematically shown in FIGS. 44(*a*)–44(*c*), by using different mandrels of selected configuration for replacement between the first and second movable holder means 157 and 166. For instance, conical springs S1 shown in FIG. 44(*a*) may be formed by using a conical mandrel M1 which is controlled for its winding position and rate of rotational speed and travel, as discussed above. Barrel-shaped springs S2 shown in FIG. 44(*b*) may be formed by using a semispindle-shaped mandrel M2. Specifically, during the first half part of the winding operation, the mandrel M2 is advanced while it is controlled for its winding position and rate of rotational speed and travel; and during the latter half part where the wire material is half wound, the mandrel M2 is returned while it is controlled for its winding position and rate of rotational speed and travel. Further, hand drum-shaped springs S3 shown in FIG. 44(*c*) may be formed by using a pair of conical mandrels M3 which are connected respectively to the first and the second movable holder means 157 and 166, with the respective forward ends removably connected and aligned with each other. Additionally, it should be noted that springs having open ends may be formed substantially the same way as discussed above, with a right cylindrical mandrel placed at a fixed angular disposition for winding and controlled for its rate of rotational speed and travel.

Also, a spring with a small angle of wind may be formed, by varying the winding position and rate of rotational speed and travel based on the controlled drive of the swivel means 138, the drive means 143 and the first and the second movable holder means 157 and 166. In addition, the angle of wind and the pitch of such springs may be corrected and even springs having unequal pitches may be formed. All of the above mentioned springs may be formed with either right-hand and left-hand wind by changing the height of the elevating pedestal 10 to suit the line of feed and by changing the direction of wind of the mandrel M.

From what has been said, the particular function and effect of the respective means of the present apparatus may be apparent as follows. The head end bender means 66 bends the head end of the wire material regulated by the head end regulator means 56 in the direction of wind so that the head end may closely contact the outer periphery of the mandrel M, thereby enabling the mandrel M to positively chuck the wire material and perform a proper winding operation. The clamp and feed-out means 91 clamps the wire material regulated and bent at its head end and feeds it into the chucking position of the mandrel M, so that any possible deflection of the material relative to the line of feed and/or swings in the peripheral direction may positively be prevented. Thus, the wire material may be formed to an accurate orientation and angle, especially at the seat portion of the head end. The tail end regulator means 104 with the regulating tool 122 regulates the tail end of the wire material at a predetermined time during the winding process so as to control the orientation of the tail end to an angle commensurate with the angle of twist of the wire material which will necessarily be developed before the remaining unwound length of the wire material is wound. Thus, undesired twist may be avoided and the wire material formed to an accurate orientation and angle, especially at the seat portion of the tail end. As a result, high quality springs with stable outer diameter and pitch may be formed, and the formed spring finished accurately by minimizing allowance for machining of seats at its opposite ends.

In wind section C, as represented in FIGS. 21, 23 and 24, the swivel means 138 includes the motor 139 mounted thereto and the rotary shaft 140 coupled to the motor 139 and threadedly received in the coupler 136 at the coupling point 133 of the fixed base 128. Therefore, the overall means 138 can be made very compact, eliminating the need for extra installation space therefor around the swivel base 129. Further, the drive means 143, being of the variable speed type, enables the mandrel M to operate at the required low or high speeds commensurate with the size of the springs to be formed. In the first and the second movable holder means 157 and 166, the second movable holder 166 is so designed as to be retracted slower than the first movable holder means 157. Thus, in the retracting movement of both the first and second means 157 and 166, the mandrel may be automatically removed from the second means 166, thereby permitting removal of a formed spring therefrom. Thus, the first and the second means 157 and 166 and the mandrel M need not be stopped for this particular operation, and manufacturing time may be reduced as much.

In wind guide means 186, for either right-hand or left-hand wind, the roller 191 aligned on the line of feed, being set at the predetermined position relative to the mandrel M, presses and guides the wire material into the orientation closely contacting the outer periphery of the mandrel M. Thus, the roller 191 can guide and hold the wire material in a rectilinear manner at all times, thereby avoiding floating (bend in the direction of wind) during the winding operation. By means of this arrangement, the mandrel M may closely wind the wire material at all times to form springs which are free from errors in outside diameter. Further, the guide position of the roller 191 is adjustable relative to the outside diameter and the shape of the mandrel M. Therefore, even with conical or hand drum-shaped springs having continously varying outside diameter, the wire material may be properly guided. Specifically, the rotational movement of the threaded shaft 194 through the controlled drive of the motor 198 causes the support sleeve 190 and the roller 191 within the holder 188 to move in the diametral direction of the mandrel M. Thus, the distance between the roller 191 and the mandrel is invariable so that the guiding position may be adjusted progressively in a stepless manner to permit positive guiding operation of the wire material. In particular, the line of feed and the guiding position and distance to the mandrel M may be accurately adjusted at a predetermined time, since the roller 191 is adjustable for displacement on an inclined line along the diametral direction of the mandrel M.

While the preferred embodiment of the invention has been illustrated and described, it will be understood by those skilled in the art that changes and modifications may be resorted to without departing from the spirit and scope of the invention.

What is claimed is:

1. A method of making a coil spring wherein a wire material taken from a heating furnace is fed on a line of feed and formed into a spring by use of a mandrel adapted to rotate on the basis of chucking position to wind the wire material, the mandrel being controlled to pivot into a predetermined angular winding position relative to the line of feed and to move in the axial direction thereof, comprising the steps of:

feeding the wire material at a selected speed continually in alignment with the line of feed;

regulating the orientation and position of the head end of the wire material in the forward part of the line of feed;

directing the wire material regulated on its head end to a chucking position established on the outer periphery of the mandrel and aligned with the line of feed;

controlling the mandrel to pivot about a fulcrum aligned with the chucking position and to shift between a reference position perpendicular to the plane of the line of feed and a winding position forming an acute angle relative to the reference position;

moving the mandrel toward and away from the predetermined winding position while removably holding the material; and regulating the tail end of the wire material at a predetermined time during winding process so as to control the orientation of the tail end to an angle commensurate with the angle of twist of the wire material which will necessarily be developed before the remaining unwound length of the wire material is wound.

2. A method as defined in claim 1 wherein said feeding step comprises the steps of:

feeding the wire material forward in the first part of the line of feed at a selected speed;

retaining the wire material which is being fed forward, while correcting the posture of the wire material and the orientation of the head end; and feeding in the latter part of the line of feed the wire material forward to the mandrel in cooperation with said feeding step in the first part of the line of feed.

3. A method as defined in claim 1 wherein said head end regulating step comprises the steps of:

providing a regulating tool formed with a regulating mouth into which the head end of the wire material is operatively engageable;

setting said regulating tool in an operative position aligned with the line of feed in timed relationship with the feed of wire material;

regulating the orientation and position of the wire material by use of said regulating tool; and returning said regulating tool to its original inoperative position outside the line of feed.

4. A method as defined in claim 1 wherein said directing step comprises the steps of:

providing a clamp mechanism having a pair of support arms adapted to operate between a closed position holding the wire material and an open position releasing the wire material;

actuating said support arms between said closed position and said open position; and reciprocating said clamp mechanism a predetermined stroke in a direction along the line of feed.

5. A method as defined in claim 1 wherein said winding position controlling step comprises the steps of:

providing a swivel base including the mandrel for winding the wire material, the fulcrum of said swivel base being positioned vertically below the intersection of an extension line from the line of feed and the reference position perpendicular to the plane of the extension line; and controlling said swivel base with the mandrel to pivot about the fulcrum between the reference position and the winding position forming an acute angle relative to the reference position.

6. A method as defined in claim 1 wherein said mandrel moving step comprises the steps of:

providing first movable holder means within said swivel base, said first movable holder means being adapted to be connected to the base portion of the mandrel and to move a predetermined stroke along the axial direction of the mandrel, said first movable holder means including a connecting spindle adapted to removably hold the base portion of the mandrel and to be operatively connected to a suitable source of drive for rotation in a desired direction;

providing second movable holder means also within said swivel base, said second movable holder means being adapted to be connected to the fore end of the mandrel and to move a predetermined stroke along the axial direction of the mandrel, said second movable holder means including a connecting driven shaft aligned with said connecting spindle and adapted to removably hold the fore end of the mandrel, said connecting driven shaft being rotatable bodily with the mandrel;

moving both, said first and second movable holder means in synchronism with each other; and returning said second movable holder means suitably slower than said first movable holder means.

7. A method as defined in claim 1 wherein said tail end regulating step comprises the steps of:

providing a regulating tool formed at its fore end with a regulating mouth into which the tail end of the wire material is releasably received, said regulating tool being movable a predetermined stroke and shiftable between an inactive retracted position outside the line of feed and an operative position aligned with the line of feed;

moving said regulating tool suitably faster than the advancement of the wire material so as to track the tail end of the wire material;

rotating said regulating tool in a predetermined direction so as to receive and regulate the tail end of the wire material in said regulating mouth;

moving the regulating tool forwardly at substantially the same speeds as the wire material; and rotating the regulating tool during the advancement so as to control the orientation of the tail end to an angle commensurate with the angle of twist of the wire material which will necessarily be developed before the remaining unwound length of the wire material is wound.

8. An apparatus for making a coil spring including a feed section adapted to hold and feed a wire material taken from an associated heating furnace in alignment with a line of feed; and a cooperating wind section disposed transversely to the plane of said feed section and including a mandrel mounted thereon for winding the wire material, said mandrel being adapted for pivotal movement into a predetermined angular winding position relative to the line of feed and for rotational movement about and reciprocating movement along the axis thereof, comprising:

a frame forming a body of said feed section;

a fixed base mounted to said frame and supported in a generally horizontal plane relative to a floor surface;

a sliding base slidably supported on said fixed base for longitudinal movement along the line of feed;

an elevating pedestal mounted to said sliding base and adapted to be lifted obliquely relative to said sliding base;

a support base mounted to the upper forward end of said elevating pedestal;

feeder means mounted to said elevating pedestal and adapted to feed the wire material at a selected speed continually in alignment with the line of feed;

head end regulating means mounted to said support base and disposed generally in the forward part of the line of feed for regulating the orientation and position of the head end of the wire material;

clamp and feed-out means mounted to said support base and adapted to direct the wire material regulated on its head end to a chucking position established on the outer periphery of said mandrel and aligned with the line of feed;

a fixed base adapted to mount said wind section thereon and supported in a generally horizontal plane relative to a floor surface;

a swivel base forming a body of said wind section and adapted to pivot about a predetermined fulcrum between a reference position perpendicular to the plane of the line of feed and a winding position forming an acute angle relative to the reference position;

swivel means mounted to said swivel base for controlling the pivotal movement of said swivel base;

drive means mounted to said swivel base for controlling said mandrel to rotate on the basis of the chucking position;

movable holder means mounted to said swivel base for moving said mandrel toward and away from a predetermined winding position while removably holding said mandrel; and tail end regulator means mounted to said elevating pedestal and adapted to regulate the tail end of the wire material at a predetermined time during winding process so as to control the orientation of the tail end to an angle commensurate with the angle of twist of the wire material which will necessarily be developed before the remaining unwound length of the wire material is wound.

9. An apparatus as defined in claim 8 wherein said elevating pedestal comprises a fulcrum shaft carried in the rearward end thereof and a cylinder mounted to the forward end thereof, whereby said elevating pedestal is pivotally supported on said fulcrum shaft in a cantilever fashion relative to said sliding base and is obliquely shifted in response to actuation of said cylinder between a high and a low position commensurate with lines of feed for right-hand and left-hand winds of wire material.

10. An apparatus as defined in claim 8 wherein said feeder means comprises:

first feeder means for feeding the wire material forwardly at a selected speed;

posture retaining means for guiding the wire material, while correcting the posture of the wire material and the orientation of the head end; and second feeder means for feeding the wire material forwardly to said mandrel on said wind section in cooperation with said first feeder means;

said first feeder means, said posture retaining means and said second feeder means being arranged in the order in which the material is advanced on the line of feed.

11. An apparatus as defined in claim 10 wherein said first feeder means comprises a plurality of rotary shafts arranged in said elevating pedestal in sequence along the direction of material advancement, said rotary shafts extending through said elevating pedestal in a direction perpendicular to the line of feed and being operatively connected to a motor mounted to said elevating pedestal through a chain train for synchronous rotation relative to each other, each of said rotary shafts having at its fore end a roller secured thereto and aligned with the line of feed.

12. An apparatus as defined in claim 10 wherein said second feeder means comprises:

a plurality of rotary shafts axially movably arranged in said support base in sequence along the direction of material advancement and having rollers at their fore ends, respectively, said rotary shafts extending through said support base and being operatively connected to a motor mounted to said elevating pedestal through a chain train for synchronous rotation relative to each other; and a shifting mechanism disposed at the backside of said elevating pedestal and operatively connected to said rotary shafts, respectively;

whereby said rollers on said rotary shafts are adapted to shift between a position aligned with the line of feed and a retracted position.

13. An apparatus as defined in claim 12 wherein said shifting mechanism comprises:

a pivotal shaft horizontally supported between support frames secured to the backside of said elevating pedestal;

a cylinder with a rod mounted to said elevating pedestal; and a plurality of shift levers connected at one end to said pivotal shaft and at the other end to the rearward ends of said rollers, respectively, through rotation guides.

14. An apparatus as defined in claim 10 wherein said posture retaining means comprises:

a casing movably mounted to said support base and operatively connected to a cylinder with a rod secured to said support base for movement along the direction of the line of feed into a position commensurate with the length of wire material;

a pair of guide rollers for guiding the wire material in alignment with the line of feed, said guide rollers being rotatably support in said casing and operatively connected to a motor mounted to said casing through a gear train for synchronous rotation in opposite direction;

a pair of arms pivotally connected to the upper end of said casing;

a cylinder with a rod operatively connected to the upper ends of said armes; and a hold-down roller carried by said arms and adapted to shift in response to actuation of said cylinder between a guiding position holding the wire material in vertical alignment with the line of feed and a retracted position outside the line.

15. An apparatus as defined in claim 8 wherein said head end regulator means comprises:

a pivotal shaft horizontally supported in the upper forward end of said support base in a direction perpendicular to the line of feed;

a regulating tool connected to one end of said pivotal shaft and including a regulating mouth into which the head end of the wire material is operatively engageable; and a cylinder with a rod connected to the other end of said pivotal shaft;

whereby said regulating tool is tilted in response to actuation of said cylinder so as to shift between an operative position in which said tool is aligned with the line of feed and an inactive position in which said tool is retracted upwardly outside the line.

16. An apparatus as defined in claim 8 wherein said clamp and feed-out means comprises:

a carriage mounted on said support base and operatively connected to a cylinder with a rod secured to said support base, said carriage being movable a predetermined stroke in the direction of the line of feed in response to actuation of said cylinder;

a clamp mechanism disposed in said carriage and including a pair of clamp arms mounted to the front face of said carriage said arms being adapted to be synchronously closed and opened relative to each other; and a cylinder with a rod mounted to said carriage and operatively connected to one of said arms;

whereby said arms are closed and opened in response to actuation of said cylinder between an operative position holding the wire material and a released position.

17. An apparatus as defined in claim 8 wherein said swivel base is pivotally mounted to said fixed base through a fulcrum shaft and a plurality of wheels arranged on the underside of said swivel base, said fulcrum shaft being located at the intersection of the line of feed and the reference position.

18. An apparatus as defined in claim 8 wherein said swivel means comprises:

a holder secured to said fixed base at a location spaced apart from said fulcrum of said swivel base;

a coupling shaft pivotally received in said holder;

a coupler secured to said coupling shaft and having a threaded hole formed therein and extending horizontally therethrough; and a threaded shaft extending crosswise within said swivel base and threadably received in said threaded hole of said coupler, said threaded shaft being operatively connected to a reversible control motor mounted to said swivel base through a gear train;

whereby said threaded shaft is advanced and retracted for displacement relative to said coupler in response to forward and reverse drive of said motor.

19. An apparatus as defined in claim 8 wherein said drive means comprises:

a casing secured to one end of said swivel base;

a reversible control motor mounted within said casing;

a spindle mounted centrally within and extending horizontally through said casing in a direction perpendicular to the plane of said mandrel, said spindle being operatively connected to said motor through a chain train; and a driven shaft mounted within said casing in parallel relationship with said spindle and operatively connected to said spindle through a transmission gear train, said driven shaft being operatively connected to a horizontally extending spline shaft for rotating said mandrel disposed centrally within said swivel base.

20. An apparatus as defined in claim 8 wherein said movable holder means comprises:

(a) first movable holder means for removably holding the base portion of said mandrel, including:

a first movable body carried on and dependent from a rail horizontally mounted to the upper portion of said swivel base, said first movable body being operatively connected to a cylinder with a rod located below said rail, whereby said first movable body is reciprocated a predetermined interval commensurate with a required amount of travel of said mandrel in response to actuation of said cylinder;

a spline shaft horizontally supported in said first movable body and operatively connected to said drive means; and a connecting spindle supported centrally in said first movable body and operatively connected to said spline shaft through a gear train for forward and reverse rotation, said connecting spindle having therewithin a connecting bar for removably holding the base portion of said mandrel; and (b) second movable holder means for separably holding the fore end of said mandrel, including:

a second movable body carried on and dependent from said rail and threadedly supported on a feed shaft horizontally mounted to said swivel base below said rail, said second movable body being adapted to reciprocate, in response to rotational movement of said feed shaft, a predetermined interval in timed relationship with said first movable body; and a connecting driven shaft horizontally supported in the lower portion of said second movable body and aligned with said connecting spindle of said first movable body, said connecting driven shaft being provided with connector means for separably connecting and holding the fore end of said mandrel and a chucking mechanism for the wire material.

21. An apparatus as defined in claim 20 wherein said feed shaft is operatively connected to a reversible control motor mounted to the upper backside of said swivel base through a gear train and adapted to be rotated in either forward or reverse direction in response to controlled drive of said motor.

22. An apparatus as defined in claim 20 wherein said chucking mechanism comprise:

an operating bar received in a threaded hole of said connecting driven shaft;

a cylinder with a rod located rearwardly of said driven shaft, said rod being connected to the rearward end of said operating bar;

a first rack formed on the forward end of said operating bar;

a pinion pivotally mounted within said driven shaft, said pinion being engageable with said first rack; and a second rack mounted within the forward end of said driven shaft and adapted to move in the diametral direction of said driven shaft, said second rack being engageable with said pinion and adapted to securely hold thereon a chuck for the wire material located outwardly of the forward end of said mandrel;

whereby said operating bar is axially reciprocated in response to actuation of said cylinder to thereby displace said chuck in the radial direction of said mandrel.

23. An apparatus as defined in claim 22 wherein said chuck is adapted to hold the head end of the wire material and to be set in its released position before operation, and wherein the center of said chuck is located on the same vertical line as the fulcrum of said swivel base.

24. An apparatus as defined in claim 20 wherein said first movable body and said second movable body are adapted to move at variable speeds, said first movable body and said second movable body being moved forward synchronously with each other when said mandrel is advanced, and said first movable body being returned suitably faster than said second movable body when said mandrel is retracted.

25. An apparatus as defined in claim 20 wherein said mandrel is horizontally held at its opposite ends between said connecting spindle and said connecting driven shaft in axial alignment with each other, and wherein said mandrel is replaceable with another mandrel of different size.

26. An apparatus as defined in claim 8 wherein said tail end regulator means comprises:

a carriage supported on a rail horizontally mounted on said elevating pedestal, said carriage being operatively connected to a chain reciprocated by a first reversible control motor mounted to the backside of said elevating pedestal;

a tiltable body pivotally mounted to the front side of said carriage through a fulcrum shaft and operatively connected to a cylinder with a rod mounted to said carriage, said tiltable body being adapted to shift in response to actuation of said cylinder between an inoperative position tilted outside the line of feed while the wire material is fed and an operative position upstanding in alignment with the line of feed at a predetermined time while the wire material is wound;

a drive mechanism disposed on said tiltable body and including a rotary shaft horizontally mounted within said tiltable body and extending through a support sleeve secured to the forward end of said tiltable body, said rotary shaft being operatively connected to a second reversible control motor mounted to the lower portion of said tiltable body through a gear train for rotation in either forward and reverse direction;

a regulating tool mounted to the fore end of said rotary shaft and including at the fore end thereof a regulating mouth in which the tail end of the wire material is releasably received; and sensing means for confirming the tail end of the wire material being received in said mouth of said regulating tool and properly regulated for its position, said sensing means including:

a movable bar disposed movably within said rotary shaft, said movable bar having a sensing portion at its forward end and an operating portion at its reaward end, said movable bar being normally biased forwardly against the regulating tool to thereby set the sensing portion in a predetermined position in said mouth contacting the tail end of the wire material;

a sensor mounted to the upper rearward end of said tiltable body, said sensor being located opposite to said operating portion of said movable bar as it is normally in its off condition;

whereby, when said movable bar is retracted, said sensor is pushed by said operating portion and turned on to thereby start said first control motor and second control motor.

27. An apparatus as defined in claim 26 wherein said cylinder is so set as to be actuated at such time as said mandrel has wound up a required length of the wire material, thereby to bring said tiltable body into the operative position.

28. An apparatus as defined in claim 26 wherein said first control motor is so set as to be started in suitably timed relationship with actuation of said cylinder and driven to actuate said chain in response to the sensing operation of said sensor, whereby upon forward movement of said carriage and said tiltable body, said regulating tool is advaned to track the tail end of the wire material being wound, and during the tail end regulating operation in response to the sensing operation of said sensor, said carriage and said regulating tool are advanced at an equal speed to or a slightly higher speed than the winding speed of said mandrel.

29. An apparatus as defined in claim 26 wherein said second control motor is so set as to be rotated in timed relationship with the drive of said first control motor at such time as said mandrel has wound up a required length of wire material, whereby said regulating tool is advanced as it is rotated at constant speeds in a predetermined direction to prove the tail end of the wire material, and said second control motor is driven at reduced speeds when said sensor has sensed the tail end being regulated by said regulating tool or at such time as a predetermined total rotational angle for twist regulation has been reached, to thereby rotate said regulating tool at slow speeds a sufficient angle commensurate with the angle of twist of the wire material which will necessarily be developed before the remaining unwound length of the wire material is wound.

30. An apparatus for making a coil spring of either right-hand or left-hand wind including a feed section adapted to hold and feed a wire material taken from an associated heating furnace in alignment with a line of feed for either right-hand or left-hand wind; and a cooperating wind section disposed transversely to the plane of said feed section and including a mandrel mounted thereon for winding the wire material, said mandrel being adapted for pivotal movement into a predetermined angular winding position relative to the line of feed and for rotational movement about and reciprocating movement along the axis thereof, comprising:

a frame forming a body of said feed section;

a fixed base mounted to said frame and supported in a generally horizontal plane relative to a floor surface;

a sliding base slidably supported on said fixed base for longitudinal movement along the line of feed;

an elevating pedestal mounted to said sliding base and adapted to be lifted obliquely relative to said sliding base;

a support base mounted to the upper forward end of said elevating pedestal;

first and second feeder means mounted to said elevating pedestal and adapted to feed the wire material at a selected speed and continually in alignment with the line of feed;

head end regulating means mounted to said support base and disposed generally in the forward part of the line of feed for regulating the orientation and position of the head end of the wire material;

head end bender means mounted to said elevating pedestal and disposed generally in the forward part of the line of feed for bending the regulated head end of the wire material in the direction of winding;

clamp and feed-out means mounted to said support base and adapted to direct the wire material regulated and bent on its head end to a chucking position established on the outer periphery of said mandrel and aligned with the line of feed;

a fixed base adapted to mount said wind section thereon and supported in a generally horizontal plane relative to a floor surface;

a swivel base forming a body of said wind section and adapted to pivot about a predetermined fulcrum between a reference position perpendicular to the plane of the line of feed and a winding position forming an acute angle relative to the reference position;

swivel means mounted to said swivel base for controlling the pivotal movement of said swivel base;

drive means mounted to said swivel base for controlling said mandrel to rotate on the basis of the chucking position;

first and second movable holder means mounted to said swivel base for moving said mandrel toward and away from a predetermined winding position while removably holding said mandrel;

winding guide means mounted to said swivel base in alignment with the line of feed for either right-hand or left-hand wind and adapted to guide the wire material in a predetermined guiding position apart from said mandrel;

tail end regulator means mounted to said elevating pedestal and adapted to regulate the tail end of the wire material at a predetermined time during winding process so as to control the orientation of the tail end to an angle commensurate with the angle of twist of the wire material which will necessarily be developed before the remaining unwound length of the wire material is wound; and tail end hold-down means mounted to said swivel base and adapted to closely press the tail end of the wire material against the outer periphery of said mandrel when a winding operation is being completed.

31. An apparatus as defined in claim 30 wherein said head end bender means comprises:

a support frame mounted to the forward end of said elevating pedestal and including a pair of parallel guide rollers supported therein;

a first actuating cylinder with a rod mounted to the backside of said support frame and adapted to reciprocate in a direction intersecting the line of feed;

a movable body supported on said guide rollers and operatively connected to said rod of said first actuating cylinder;

a second actuating cylinder with a rod mounted to the upper rearward end of said movable body;

an actuating bar movably mounted within said movable body above said rollers and operatively connected to said rod of said second actuating cylinder; and a pair of bending arms pivotally connected to the forward end of said movable body and adapted to be closed and opened in response to actuation of said actuating bar.

32. An apparatus as defined in claim 31 wherein, when said movable body is retracted in response to actuation of said first actuating cylinder, said bending arms are moved into an inactive position outside the line of feed as they are in their open position, and as soon as the head end of the wire material is regulated by said head end regulator means, said bending arms in the open position are advanced into an operative position aligned with the line of feed and closed in response to actuation of said second actuating cylinder, to thereby hold the head end of the wire material.

33. An apparatus as defined in claim 31 wherein each of said bending arms includes at its forward end a clamp half for bending the head end of the wire material, said clamp half being replaceable in accordance with either right-hand or left-hand wind of wire material.

34. An apparatus as defined in claim 30 wherein said wind guide means are two in number for either right-hand or left-hand wind and mounted to the upper portion and the lower portion of said swivel base, respectively, in front of said mandrel, each of said wind guide means comprises:

a carrier plate mounted centrally to the front of said swivel base, said carrier plate being adjustable for its angular disposition in the same direction as the peripheral direction of said mandrel, a holder carried on said carrier plate with a predetermined inclination toward the center of said mandrel;

a support sleeve movably received in and extending through said holder; and a roller connected to the upper end of said support sleeve and adapted to press and guide the wire material;

whereby said roller is adapted to move toward and away from said mandrel, to thereby adjust the guiding position relative to the wire material.

35. An apparatus as defined in claim 30 wherein said tail end hold-down means comprises:

a support lever pivotally suppoted to said swivel base adjacent the back periphery of said mandrel;

a cylinder with a rod mounted to the upper portion of said swivel base and operatively connected to one end of said support lever; and a roller adapted for pressing the wire material and connected to the other end of said support lever in alignment with an extension line from the line of feed;

whereby said support lever is tilted in response to actuation of said cylinder, to thereby shift said roller in the diametral direction of said mandrel between a first position unclamping the wire material and a second position pressing the wire material.

* * * * *